US012064017B1

(12) United States Patent
Polonsky et al.

(10) Patent No.: US 12,064,017 B1
(45) Date of Patent: Aug. 20, 2024

(54) ENHANCED RECYCLABLE CASE SYSTEM

(71) Applicant: Pioneer Square Brands, Inc., High Point, NC (US)

(72) Inventors: Daniel Polonsky, Stevenville, WA (US); Brian Lewis Piper, Seattle, WA (US)

(73) Assignee: Pioneer Square Brands, Inc., High Point, NC (US)

( * ) Notice: Subject to any disclaimer, the term of this patent is extended or adjusted under 35 U.S.C. 154(b) by 0 days.

(21) Appl. No.: 18/629,490

(22) Filed: Apr. 8, 2024

(51) Int. Cl.
*A45C 11/00* (2006.01)

(52) U.S. Cl.
CPC ..... *A45C 11/00* (2013.01)

(58) Field of Classification Search
CPC ..... A45C 11/00
USPC ..... 428/192; 206/308.1, 524.1, 524.6, 701
See application file for complete search history.

(56) References Cited

U.S. PATENT DOCUMENTS

2013/0092562 A1* 4/2013 Wyner ..... A45C 13/02 206/521
2013/0292269 A1* 11/2013 Tages ..... H05K 5/0086 206/37
2018/0055166 A1* 3/2018 Rodriguez ..... A45C 11/00

* cited by examiner

*Primary Examiner* — Jacob K Ackun
(74) *Attorney, Agent, or Firm* — Grandview Law

(57) ABSTRACT

A case system includes (I) a first material component including (A) at least one aperture including at least one edge, (B at least one border portion extending from the at least one edge of the aperture, and (C) at least one elongated portion. The case system also includes (II) a second material component including (A) at least one aperture plug portion extending through the at least one aperture of the first material component, and (B) at least one edge portion extending from the plug portion, wherein the at least one border portion of the first material and the at least one edge portion of the second material are coupled via co-molding, and wherein the first material component is co-molded before the co-molding with the second material component. Other aspects are described in the claims, drawings, and text forming a part of the present disclosure.

20 Claims, 30 Drawing Sheets

ENHANCED RECYCLABLE CASE SYSTEM

SUMMARY

In one or more aspects a case system including (I) a first material component including (A) at least one aperture including at least one edge, (B at least one border portion extending from the at least one edge of the aperture, and (C) at least one elongated portion; and (II) a second material component including (A) at least one aperture plug portion extending through the at least one aperture of the first material component, and (B) at least one edge portion extending from the plug portion, wherein the at least one border portion of the first material and the at least one edge portion of the second material are coupled via co-molding, and wherein the first material component is molded before being co-molded with the second material component. Wherein the first material component has a first density, wherein the second material component has a second density, and wherein the first density is greater than the second density. Wherein the second material component includes at least one thermoplastic elastomer. Wherein the second material component includes at least one thermoplastic polyurethane. Wherein the first material component includes at least one polycarbonate. Wherein the first material component includes at least one acrylonitrile butadiene styrene. Wherein when a force applied to the at least one plug portion greater than a predetermined force, the at least one border portion of the first material component and the at least one edge portion of the second material component separate from one another. Wherein the predetermined force is greater than 15 pounds. Wherein the predetermined force is dependent upon at least one dimension of the at least one border portion of the first material component. Wherein the at least one dimension is at least one width of the at least one border portion of the first material component. Wherein the predetermined force is dependent upon a dimension of the at least one edge portion of the second material component. Wherein the at least one dimension is at least one area of the at least one edge portion of the second material component. Wherein the first material component and the second material component are co-molded in a predetermined temperature range. Wherein the predetermined temperature range includes a temperature range between 300 degrees Fahrenheit and 400 degrees Fahrenheit. Wherein the aperture is noncircular. Wherein the first material component further includes at least one elongated portion extending from the at least one aperture, wherein the second material component further includes at least one elongated portion extending from the at least one aperture plug portion, wherein the at least one elongated portion of the first material component and the at least one elongated portion of the second material component are coupled via co-molding, wherein the first material component further includes at least one corner portion spaced from the at least one aperture, wherein the second material component further includes at least one corner portion spaced from the at least one aperture plug portion, and wherein the at least one corner portion of the first material component and the at least one corner portion of the second material component are coupled via co-molding. Wherein the at least one elongated portion of the first material component is separable from the at least one elongated portion of the second material component via at least one pulling force subsequent to separation of the at least one border portion of the first material from the at least one edge portion of the second material, and wherein the at least one corner portion of the first material component is separable from the at least one corner portion of the second material component via at least one pulling force subsequent to separation of the at least one border portion of the first material from the at least one edge portion of the second material. Wherein the first material component and the second material component form at least a sub-assembly portion of a case for a portable electronic device.

In one or more aspects a case system including (I) a first material component including (A) at least one aperture including at least one edge, (B at least one border portion extending from the at least one edge of the aperture, and (C) at least one elongated portion; and (II) a second material component including (A) at least one aperture plug portion extending through the at least one aperture of the first material component, and (B) at least one edge portion extending from the plug portion, wherein the at least one border portion of the first material and the at least one edge portion of the second material are coupled via co-molding at a temperature in a temperature range between 300 degrees Fahrenheit and 400 degrees Fahrenheit, and wherein the first material component is molded before the co-molding with the second material component.

In one or more aspects a case system including a (I) a first material component including (A) at least one aperture including at least one edge, (B at least one border portion extending a width dimension from the at least one edge of the aperture, and (C) at least one elongated portion; and (II) a second material component including (A) at least one aperture plug portion extending through the at least one aperture of the first material component, and (B) at least one edge portion extending the width dimension from the plug portion, wherein the at least one border portion of the first material and the at least one edge portion of the second material are coupled via co-molding, and wherein the first material component has a first density and the second material component has a second density smaller than the first density of the first material component.

In addition to the foregoing, other aspects are described in the claims, drawings, and text forming a part of the disclosure set forth herein. Various other aspects are set forth and described in the teachings such as text (e.g., claims and/or detailed description) and/or drawings of the present disclosure. The foregoing is a summary and thus may contain simplifications, generalizations, inclusions, or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

Figure 1:
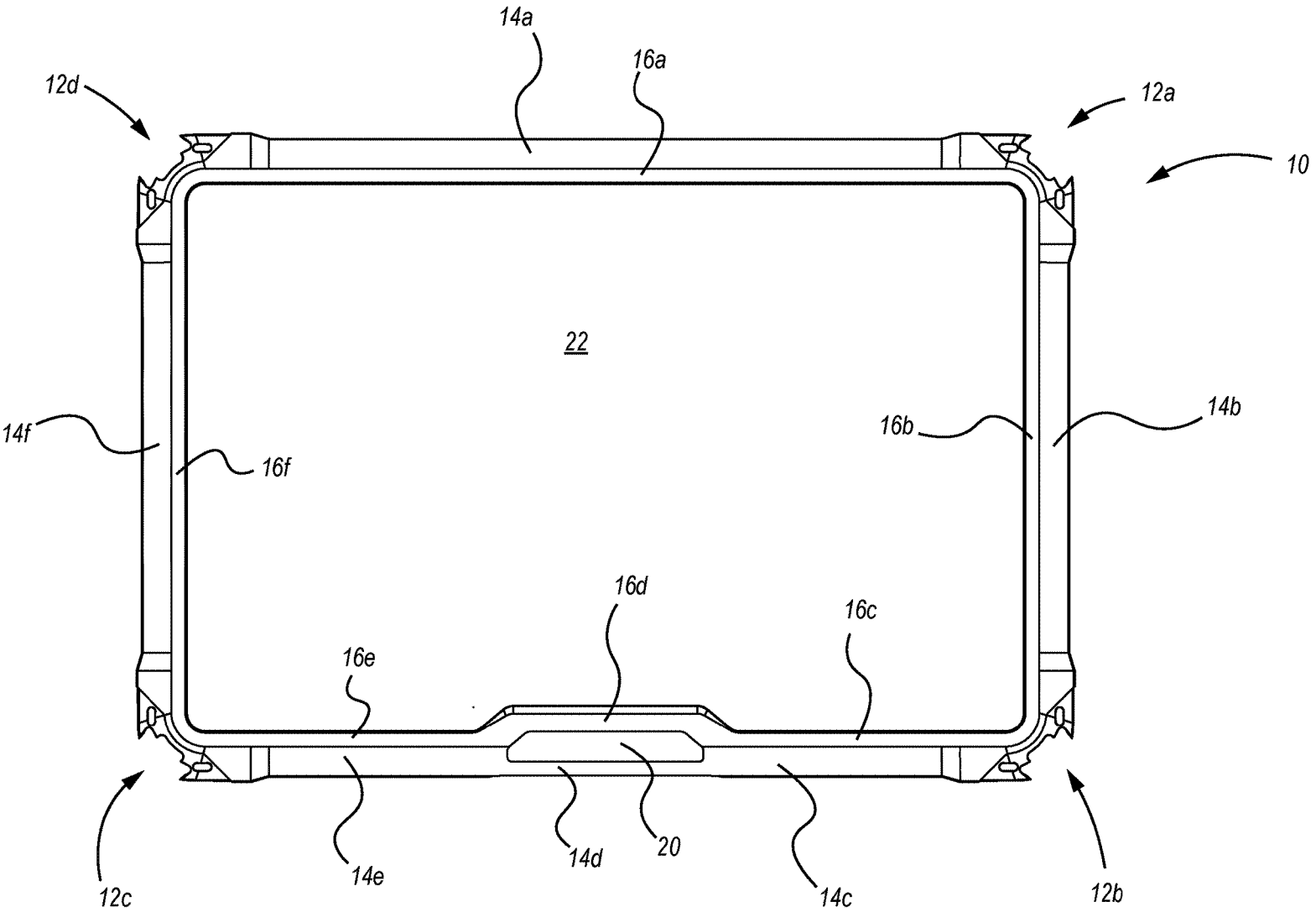
FIG. 1 is a top plan view of a first material component.

With reference now to the figures, shown are one or more examples of Enhanced Recyclable Case System, articles of manufacture, compositions of matter for same that may provide context, for instance, in introducing one or more processes and/or devices described herein.

DETAILED DESCRIPTION

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is a top plan view of first material component 10. Depicted implementation of first material component 10 is shown to include corner portion 12*a*, corner portion 12*b*, corner portion 12*c*, and corner portion 12*d*. Depicted implementation of first material component 10 is shown to include elongated portion 14*a*, elongated portion 14*b*, elongated portion 14*c*, border portion 14*d*, elongated portion 14*e*, and elongated portion 14*f*. Depicted implementation of first material component 10 is shown to include elongated portion 16*a*, elongated portion 16*b*, elongated portion 16*c*, border portion 16*d*, elongated portion 16*e*, and elongated portion 16*f*. Depicted implementation of first material component 10 is shown to include aperture 20, and cover pane 22. In implementations, first material component 10 can be selected from such materials as ABS—acrylonitrile butadiene styrene, PC—polycarbonate, PMMA—polymethy methacrylate, PP—polypropylene, PET—polyethylene terephthalate, etc.

Figure 1A:
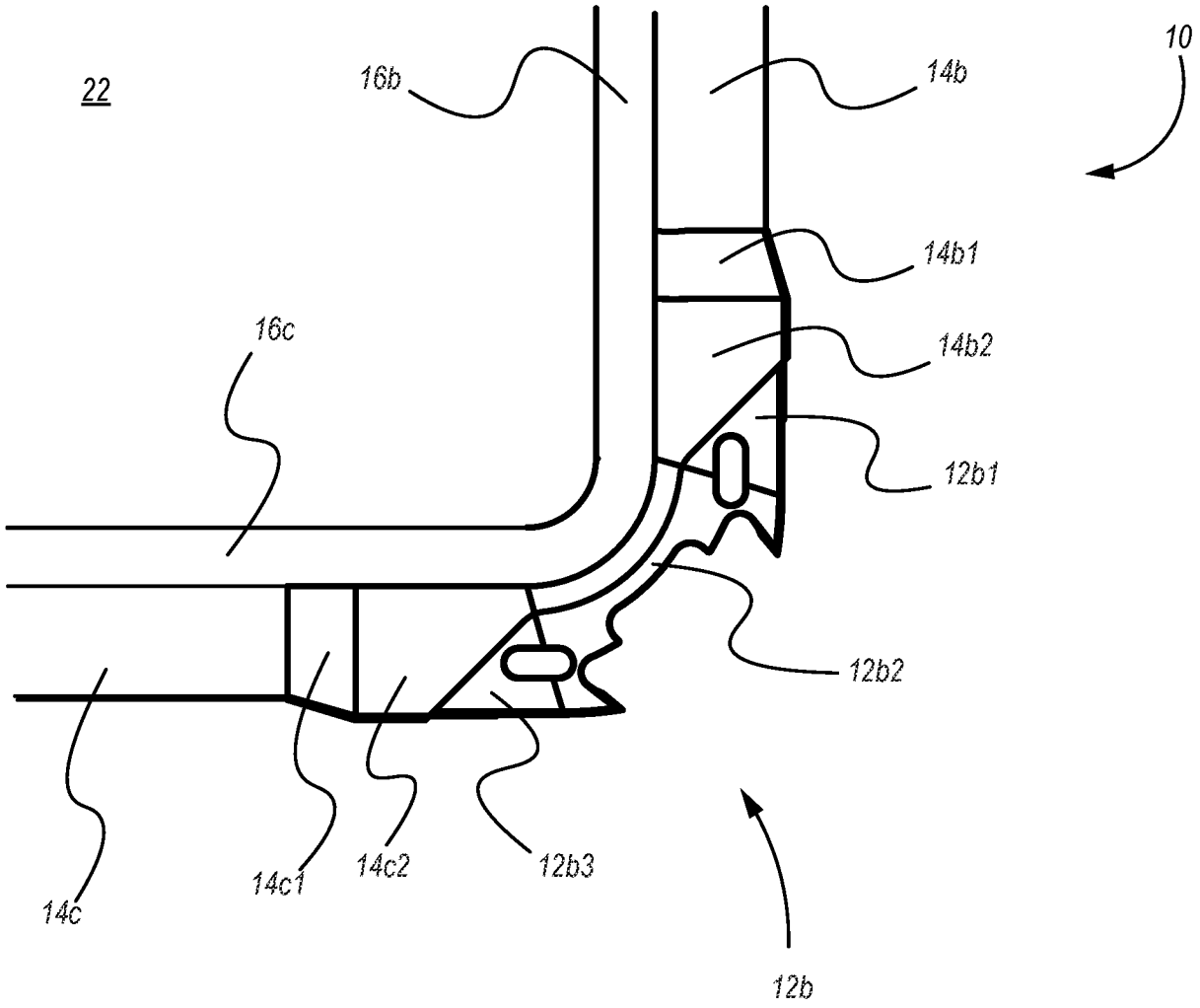
FIG. 1A is an enlarged top plan view of a portion of the first material component of FIG. 1.

Turning to FIG. 1A, depicted therein is a an enlarged top plan view of a portion of first material component 10. Depicted implementation of corner portion 12*b* is shown to include corner portion 12*b*1, corner portion 12*b*2, and corner portion 12*b*3. Depicted implementation of elongated portion 14*b* is shown to include elongated portion 14*b*1, and elongated portion 14*b*2. Depicted implementation of elongated portion 14*c* is shown to include elongated portion 14*c*1, and elongated portion 14*c*2.

Figure 1B:
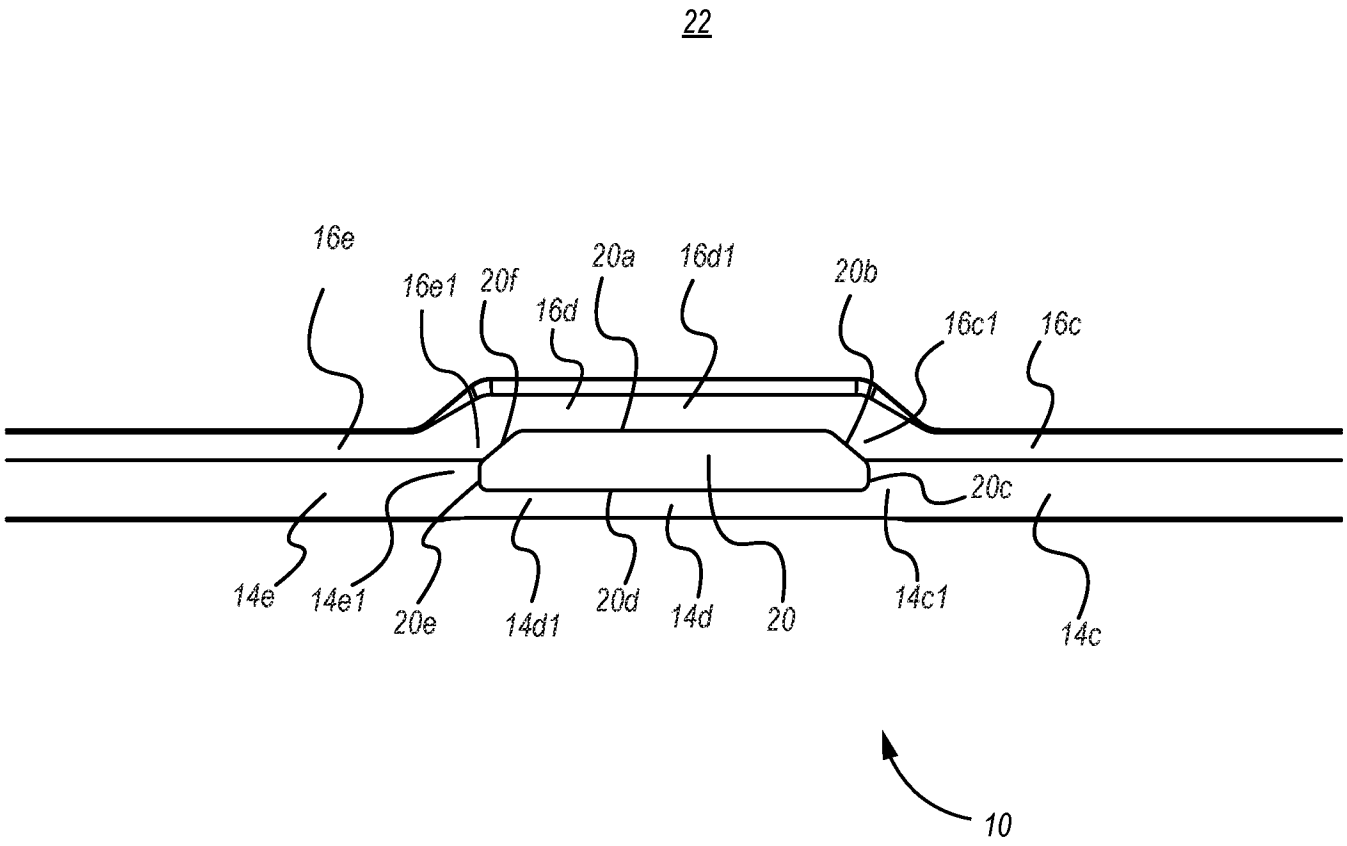
FIG. 1B is an enlarged top plan view of a portion of the first material component of FIG. 1.

Turning to FIG. 1B, depicted therein is an enlarged top plan view of a portion of first material component 10. Depicted implementation of first material component 10 is shown to include edge portion 14*c*3, and edge portion 14*d*1, and edge portion 14*e*1. Depicted implementation of first material component 10 is shown to include edge portion 16*c*1, and edge portion 16*d*1, and edge portion 16*e*1. Depicted implementation of aperture 20 is shown to include aperture edge 20*a*, aperture edge 20*b*, aperture edge 20*c*, aperture edge 20*d*, aperture edge 20*e*, and aperture edge 20*f*.

Figure 2:
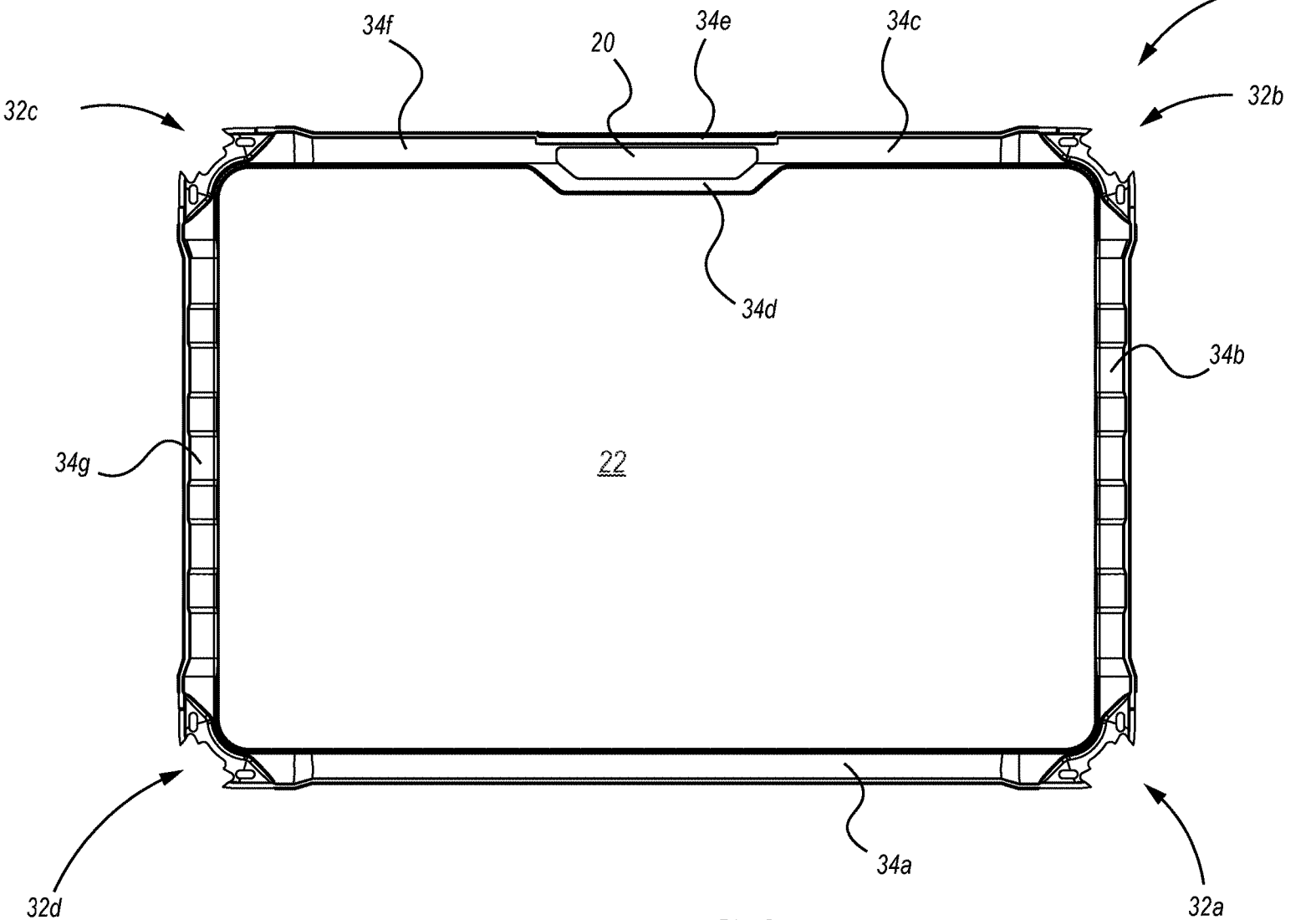
FIG. 2 is a bottom plan view of the first material component of FIG. 1.

Turning to FIG. 2, depicted therein is a bottom plan view of first material component 10. Depicted implementation of first material component 10 is shown to include corner portion 32*a*, corner portion 32*b*, corner portion 32*c*, and corner portion 32*d*. Depicted implementation of first material component 10 is shown to include elongated portion 34*a*, elongated portion 34*b*, elongated portion 34*c*, bordering portion 34*d*, bordering portion 34*e*, elongated portion 34*f*, and elongated portion 34*g*.

Figure 2A:
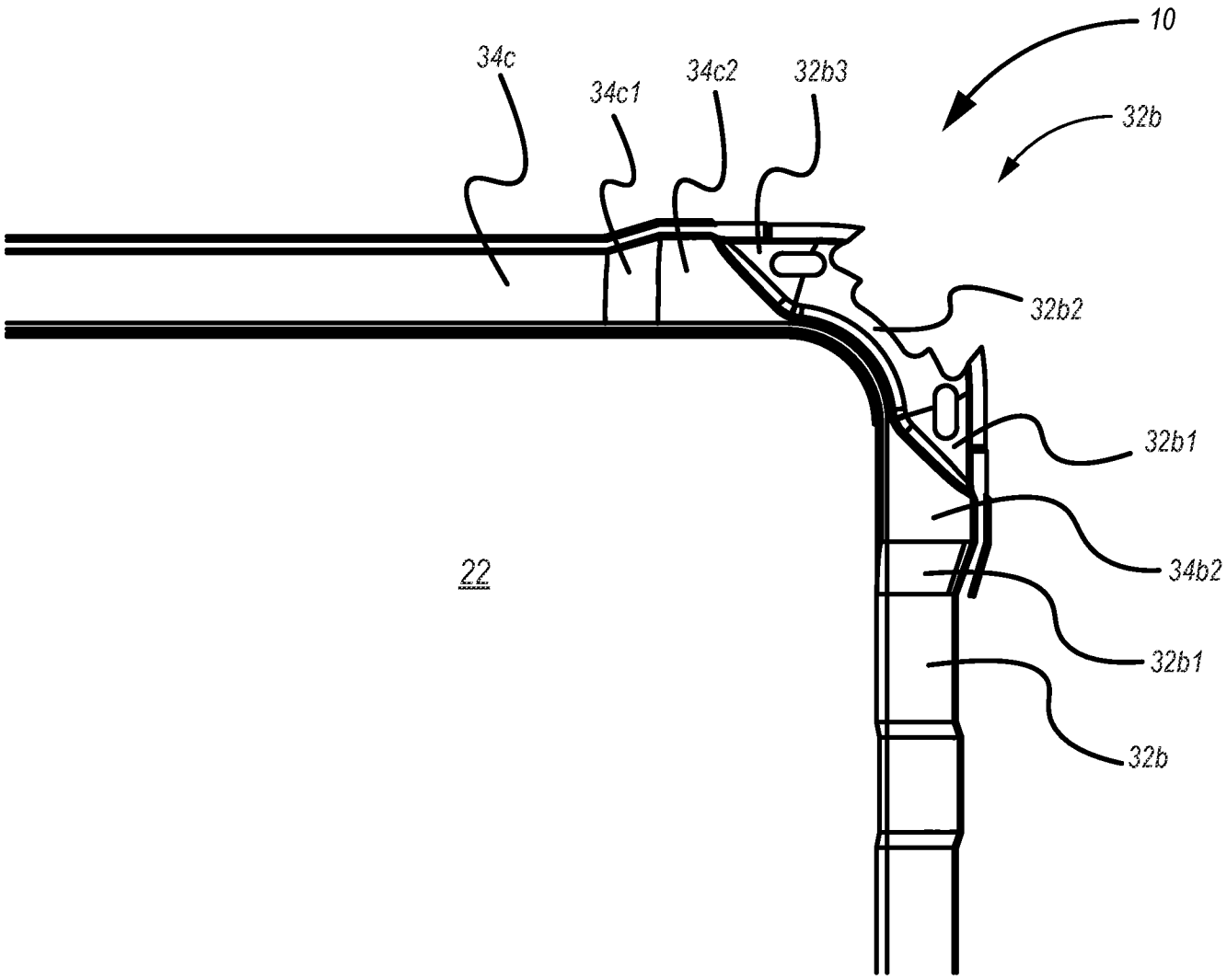
FIG. 2A is an enlarged bottom plan view of a portion of the first material component of FIG. 1.

Turning to FIG. 2A, depicted therein is an enlarged bottom plan view of a portion of first material component 10. Depicted implementation of first material component 10 is shown to include corner portion 32*b*1, corner portion 32*b*2, and corner portion 32*b*3. Depicted implementation of first material component 10 is shown to include elongated portion 34*b*1, elongated portion 34*b*2, elongated portion 34*c*1, and elongated portion 34*c*2.

Figure 2B:
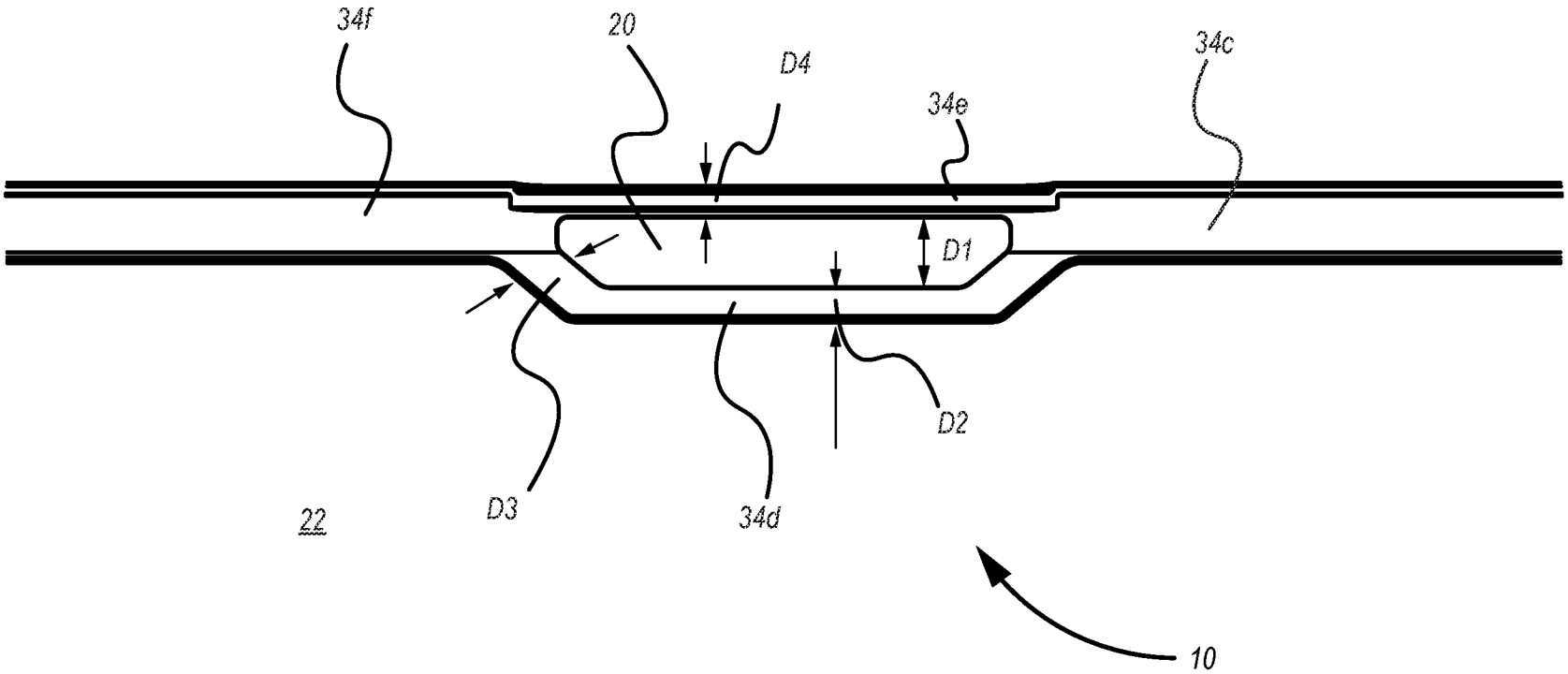
FIG. 2B is an enlarged bottom plan view of a portion of the first material component of FIG. 1.

Turning to FIG. 2B, depicted therein is an enlarged bottom plan view of a portion of first material component 10 to include dimension D1, dimension D2, dimension D3, and dimension D4.

Figure 3:
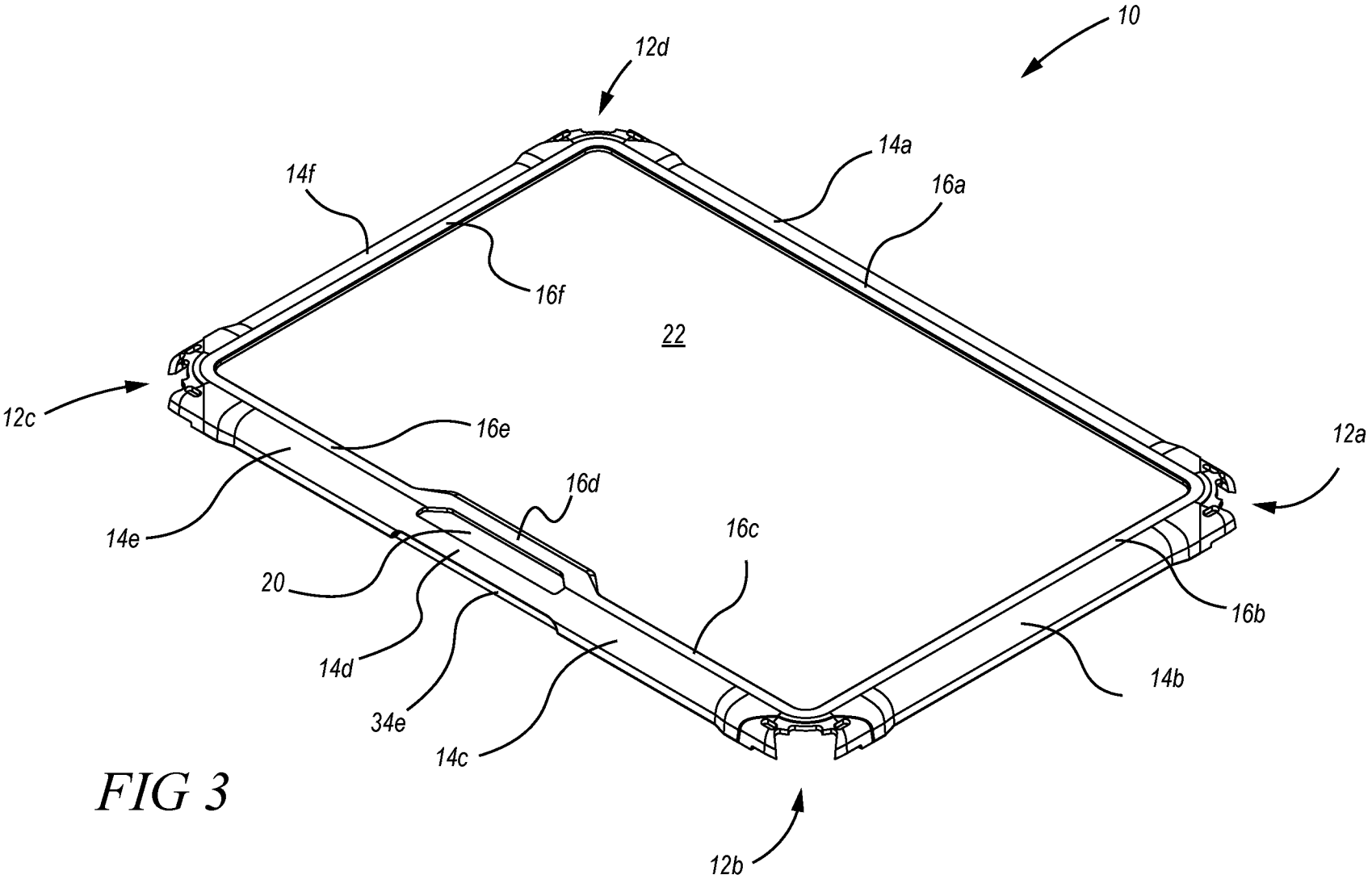
FIG. 3 is a top perspective view of the first material component of FIG. 1.

Turning to FIG. 3, depicted therein is a top perspective view of first material component 10.

Figure 4:
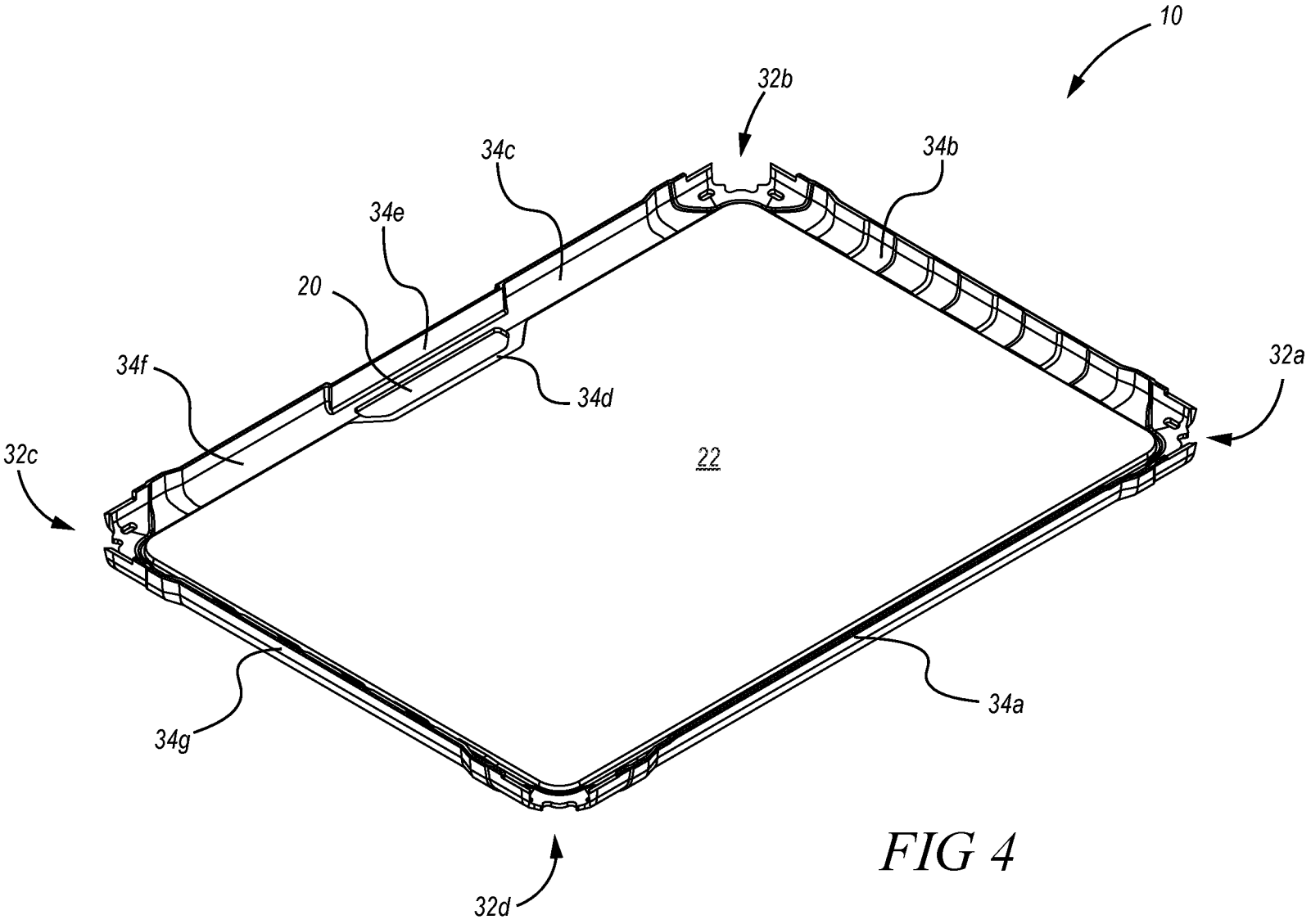
FIG. 4 is a bottom perspective view of the first material component of FIG. 1.

Turning to FIG. 4, depicted therein is a bottom perspective view of first material component 10.

Figure 5:
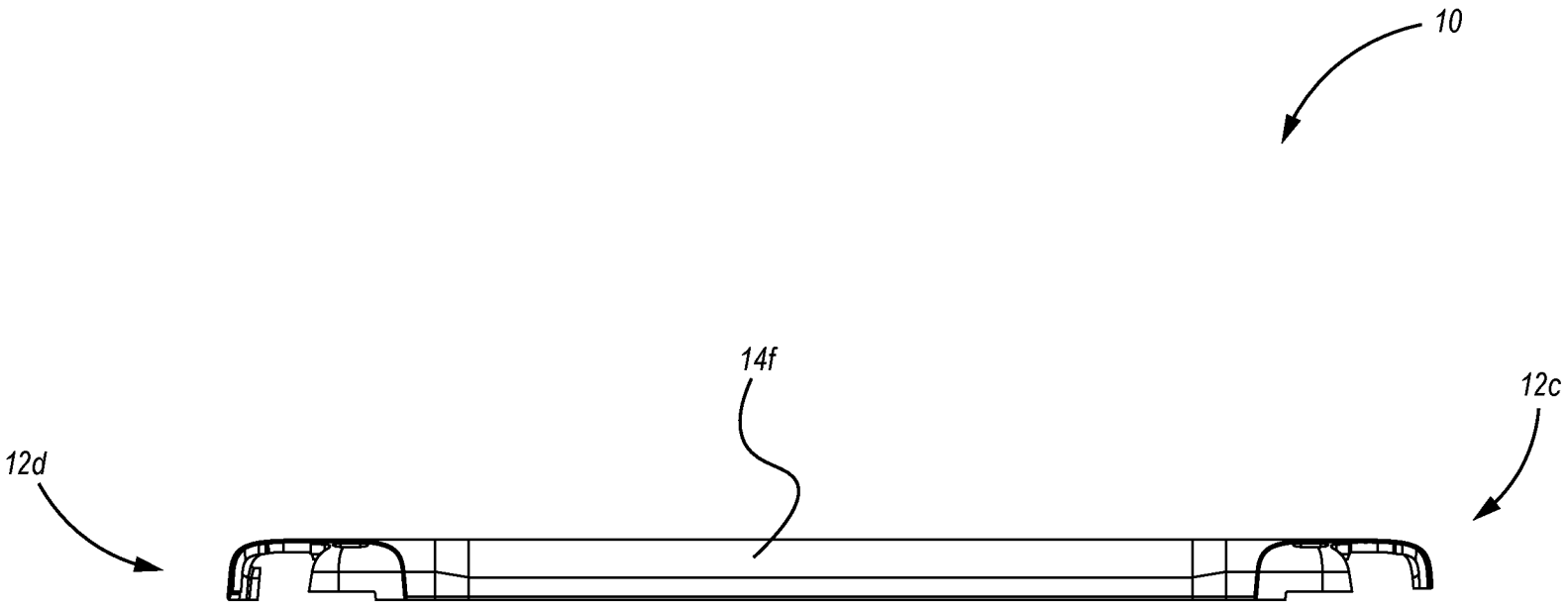
FIG. 5 is a side-elevational view of the first material component of FIG. 1.

Turning to FIG. 5, depicted therein is a side-elevational view of first material component 10.

Figure 6:
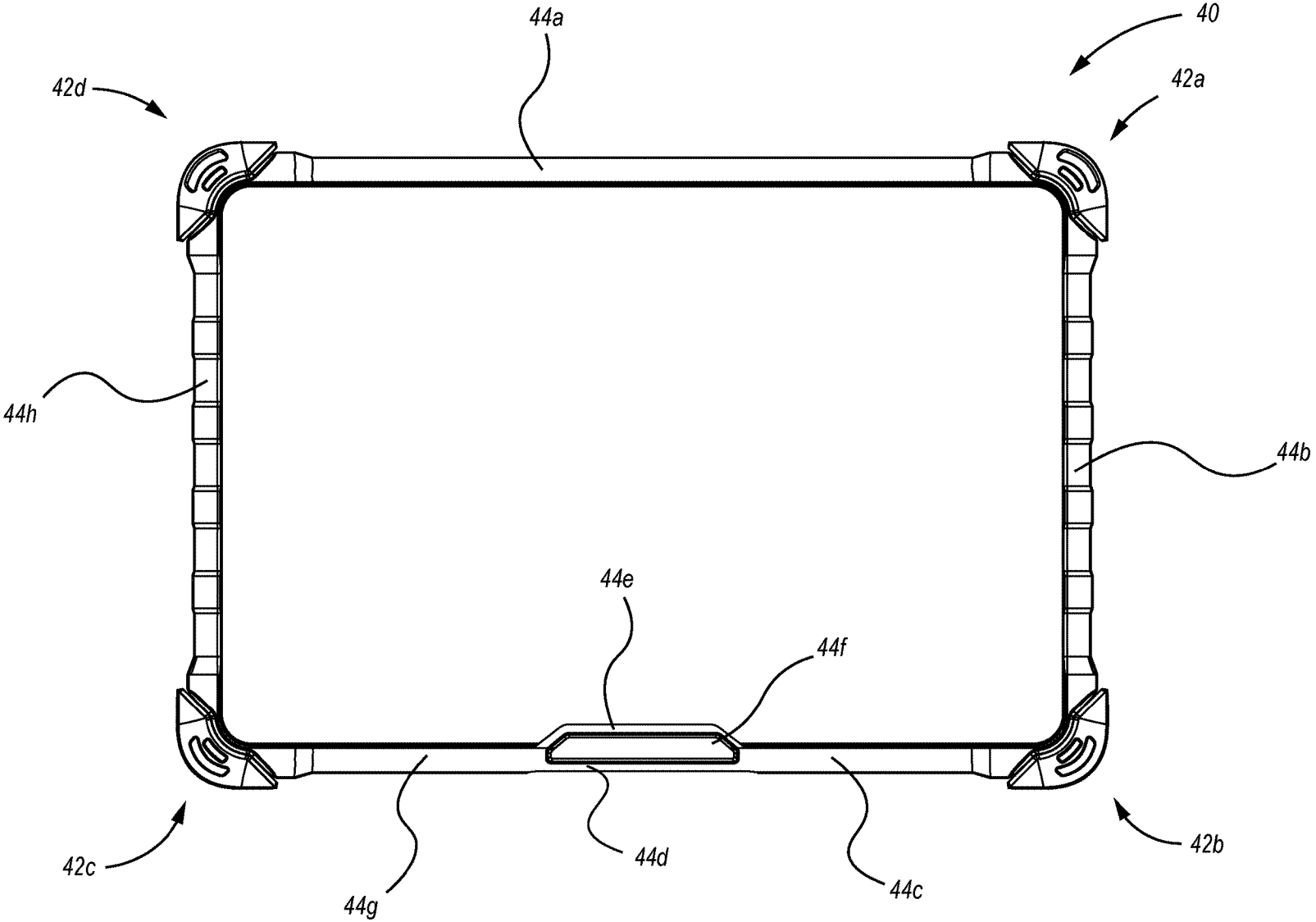
FIG. 6 is a top plan view of a second material component.

Turning to FIG. 6, depicted therein is a top plan view of second material component 40, which is shown for illustration purposes as a separate entity but as described below is in actuality co-molded with first material component 10, which unlike second material component 40, first material component 10 is molded before co-molding with second material component 40. In implementations, second material component 40 can be selected from materials such as TPE—thermoplastic elastomer, TPU—thermoplastic polyurethane, etc., which generally have densities of lesser values than the densities of the materials used for the first material component 10.

Depicted implementation of second material component 40 is shown to include corner portion 42*a*, corner portion 42*b*, corner portion 42*c*, and corner portion 42*d*. Depicted implementation of second material component 40 is shown to include elongated portion 44*a*, elongated portion 44*b*, elongated portion 44*c*, bordering portion 44*d*, bordering portion 44*e*, aperture plug 44*f*, elongated portion 44*g*, and elongated portion 44*h*.

Figure 6A:
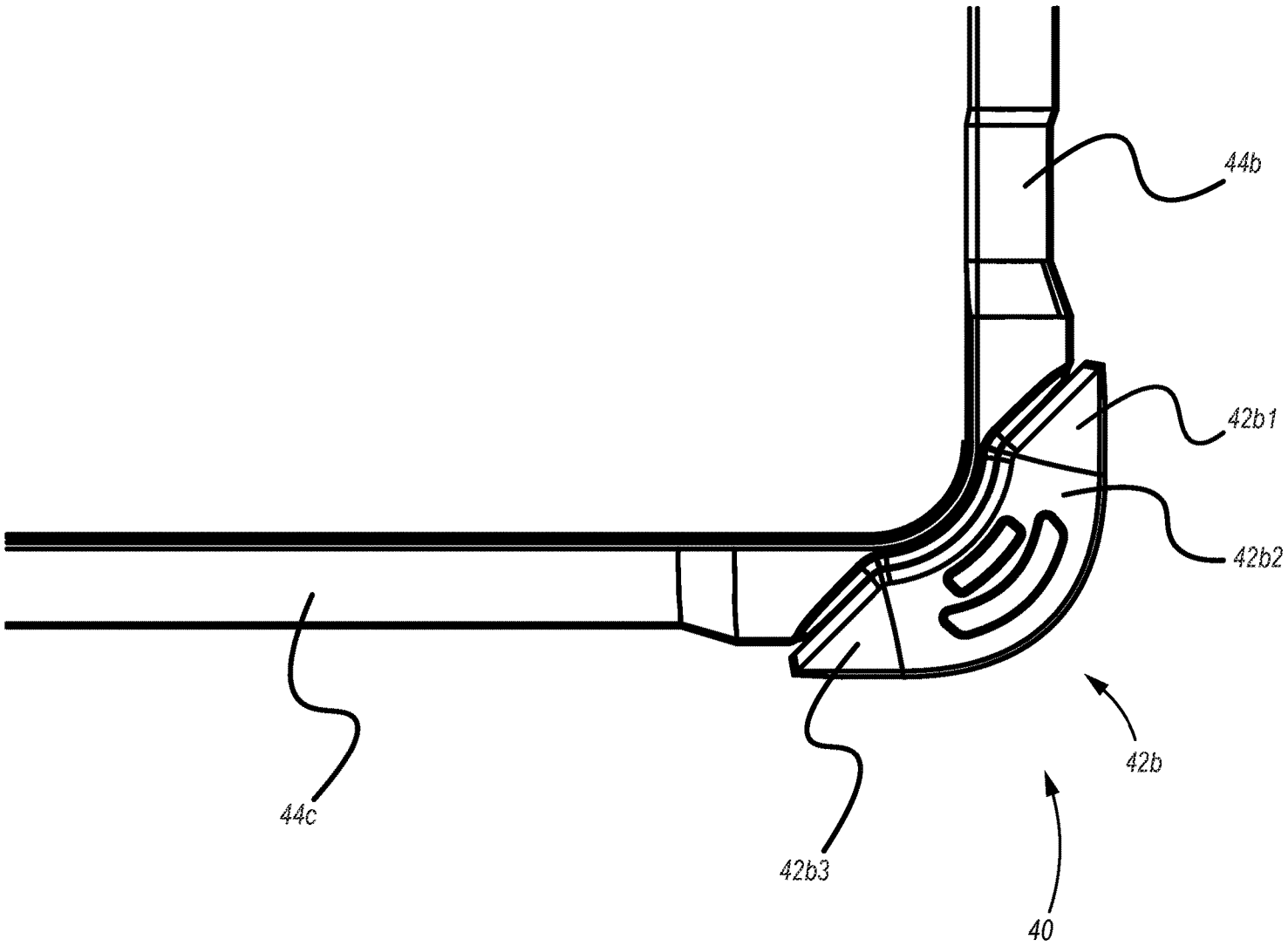
FIG. 6A is an enlarged top plan view of a portion of the second material component of FIG. 6.

Turning to FIG. 6A, depicted therein is an enlarged top plan view of second material component 40. Depicted implementation of second material component 40 is shown to include corner portion 42*b*1, corner portion 42*b*2, and corner portion 42*b*3.

Figure 6B:
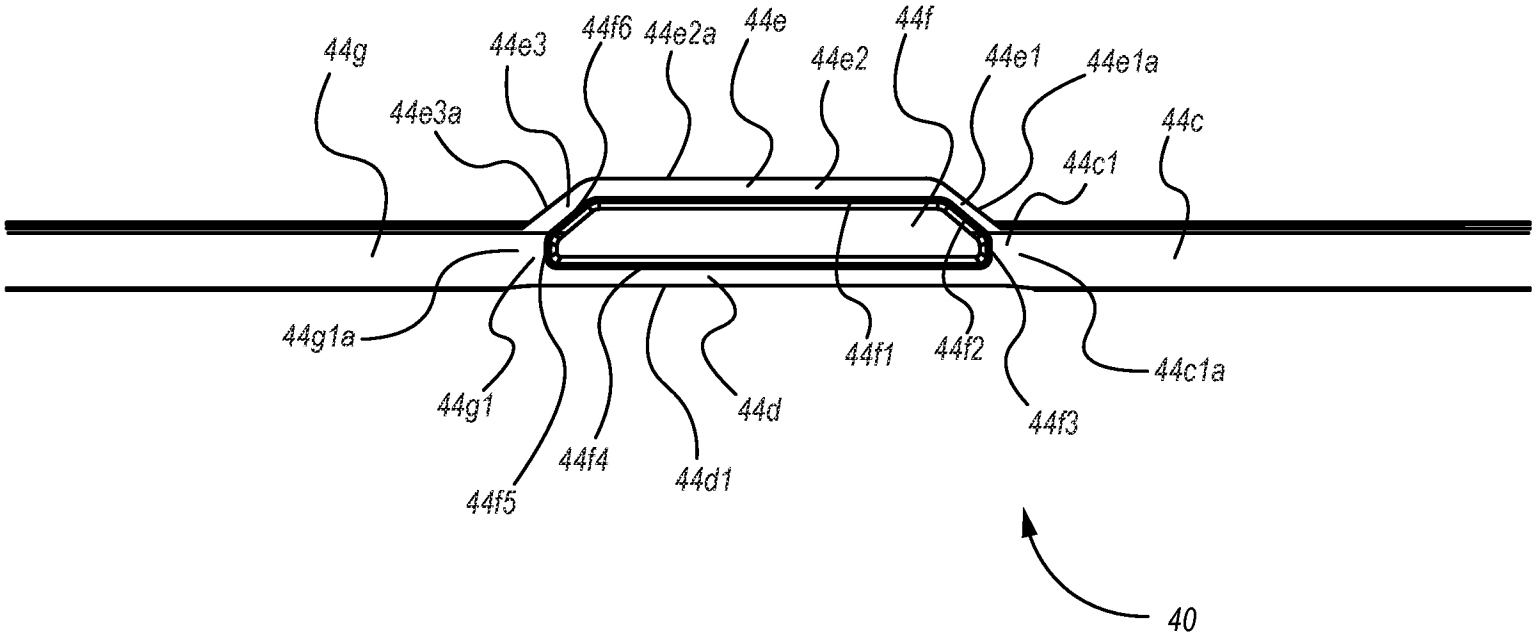
FIG. 6B is an enlarged top plan view of a portion of the second material component of FIG. 6.

Turning to FIG. 6B, depicted therein is an enlarged top plan view of second material component 40. Depicted implementation of second material component 40 is shown to include edge portion 44*c*1 with edge 44*c*1*a*, edge 44*d*1, and edge portion 44*e*1 with edge 44*e*1*a*, edge portion 44*e*2, edge 44*e*2*a*, edge portion 44*e*3, edge 44*e*3*a*, edge 44*f*1, edge 44*f*2, edge 44*f*3, and edge 44*f*4, edge 44*f*5, edge 44*f*6, and edge portion 44*g*1 with edge 44*g*1*a*.

Figure 7:
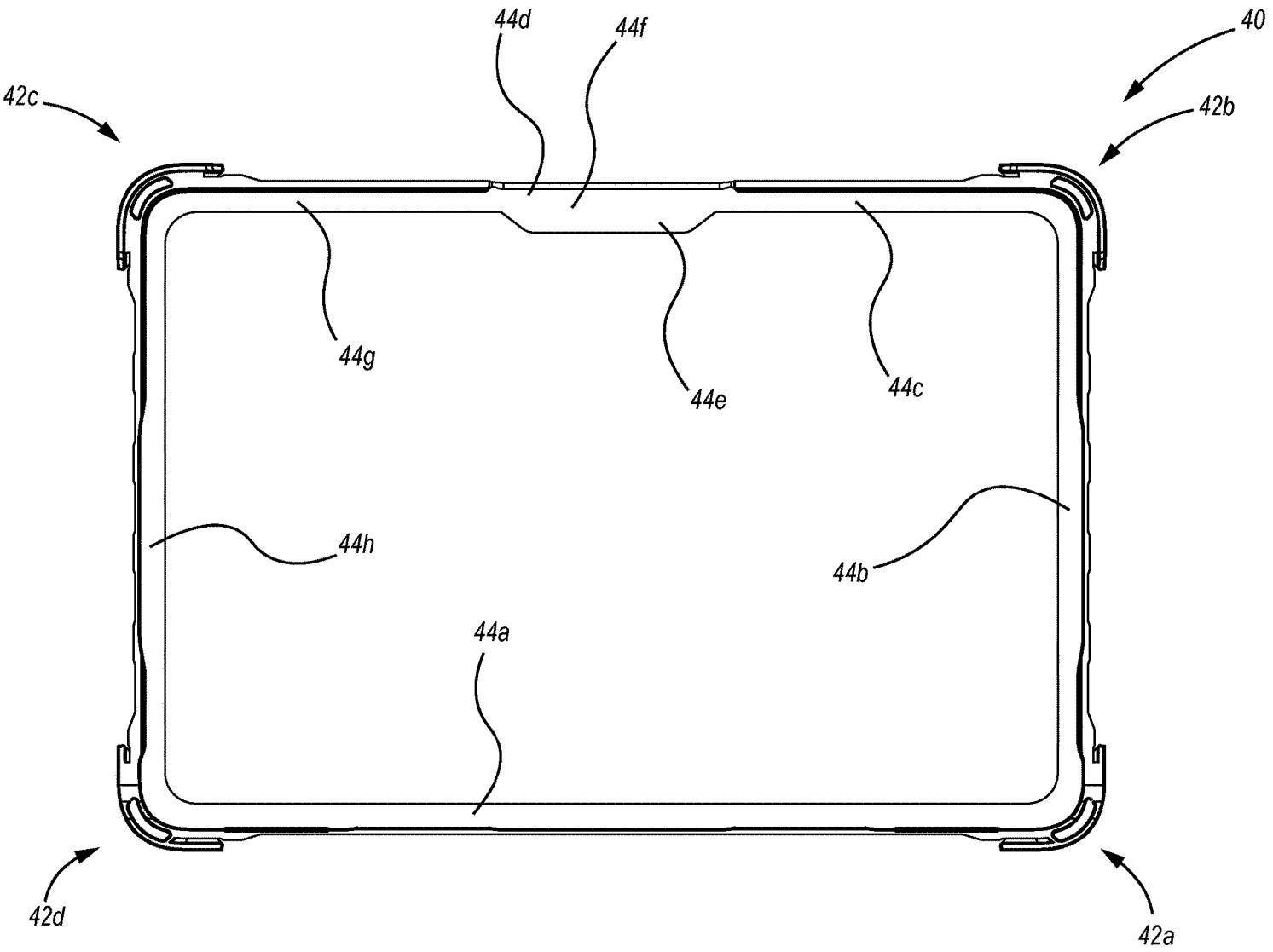
FIG. 7 is a bottom plan view of the second material component of FIG. 6.

Turning to FIG. 7, depicted therein is a bottom plan view of second material component 40.

Figure 8:
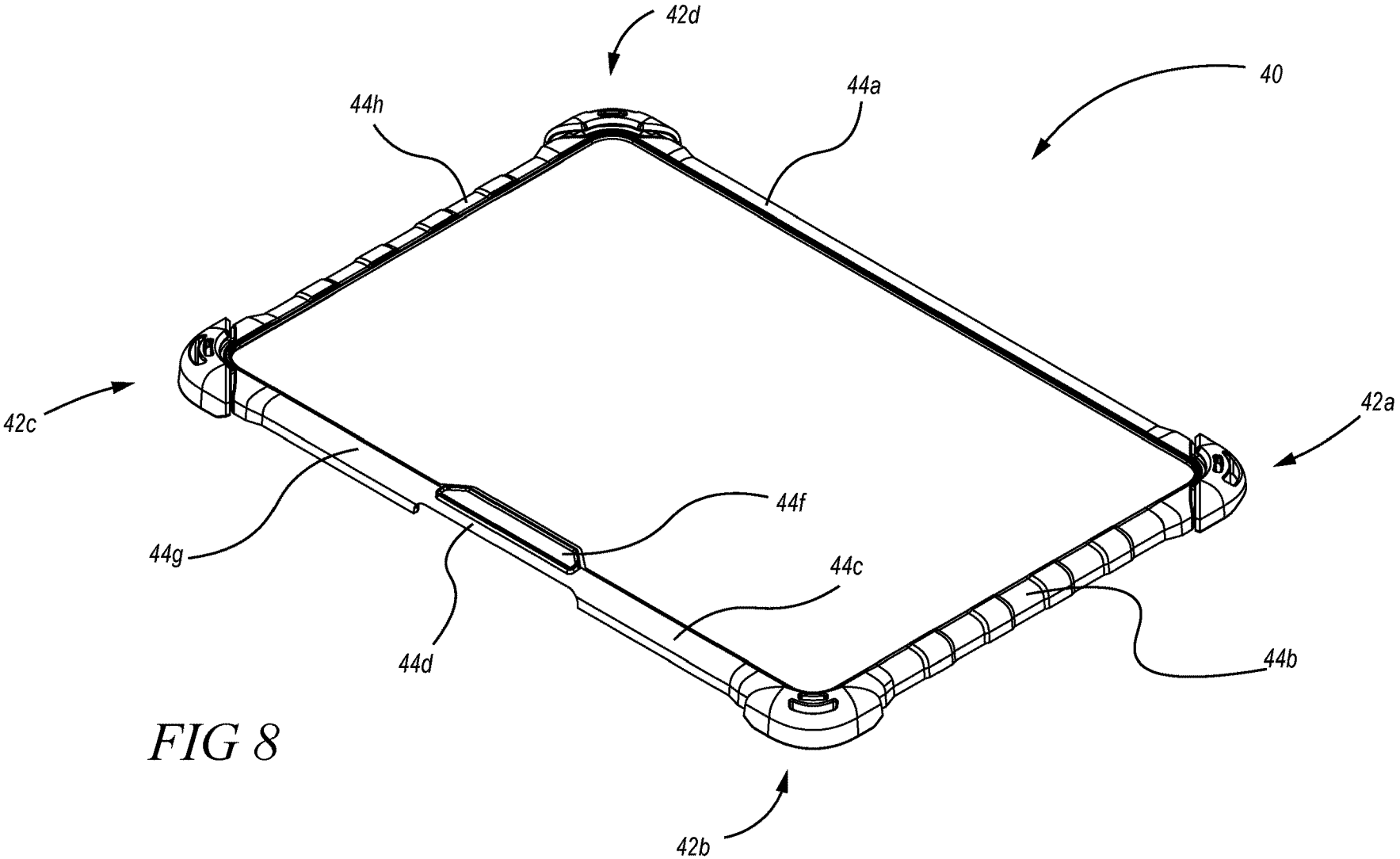
FIG. 8 is a top perspective view of the second material component of FIG. 6.

Turning to FIG. 8, depicted therein is a top perspective view of second material component 40.

Figure 9:
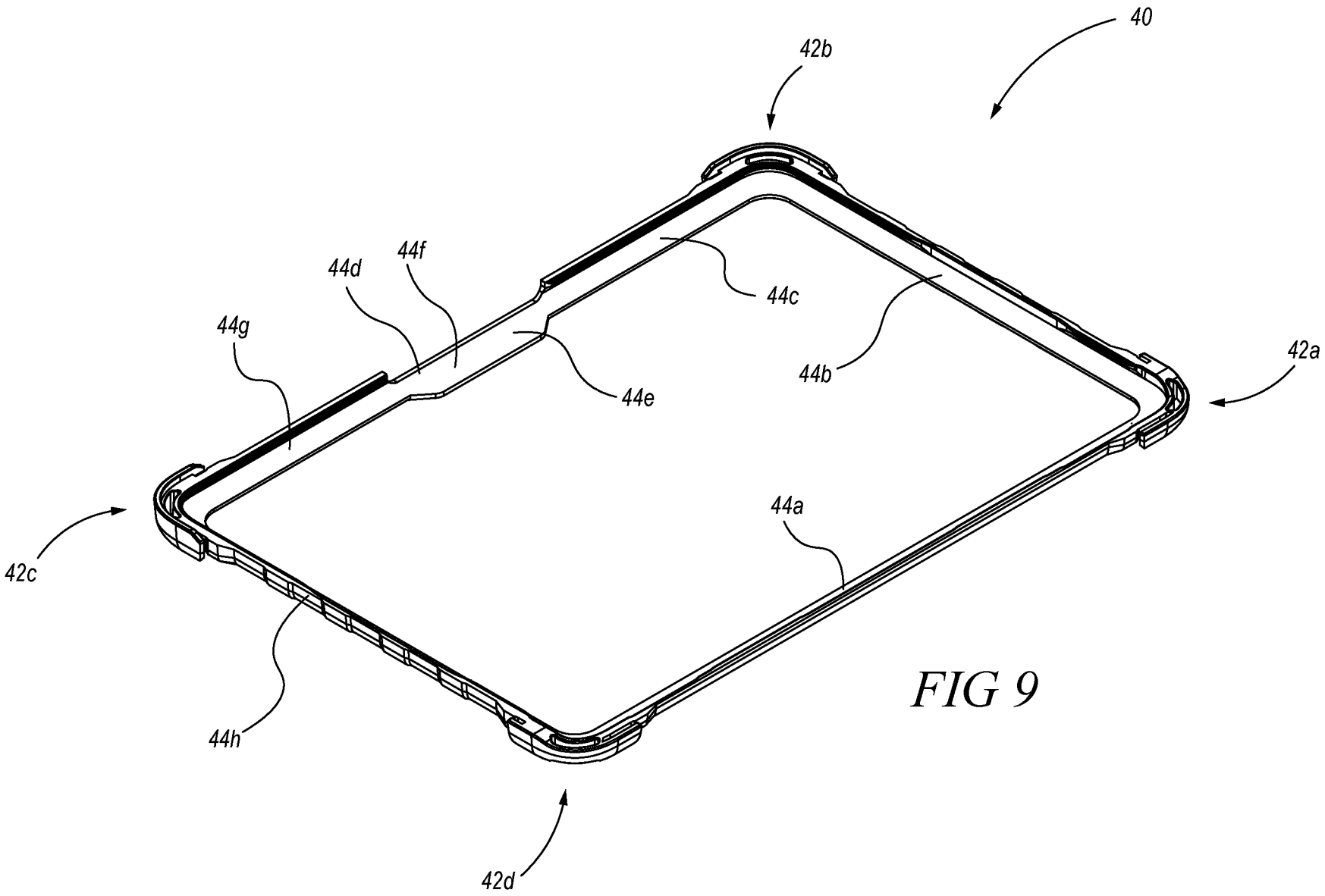
FIG. 9 is a bottom perspective view of the second material component of FIG. 6.

Turning to FIG. 9, depicted therein is a bottom perspective view of second material component 40.

Figure 10:
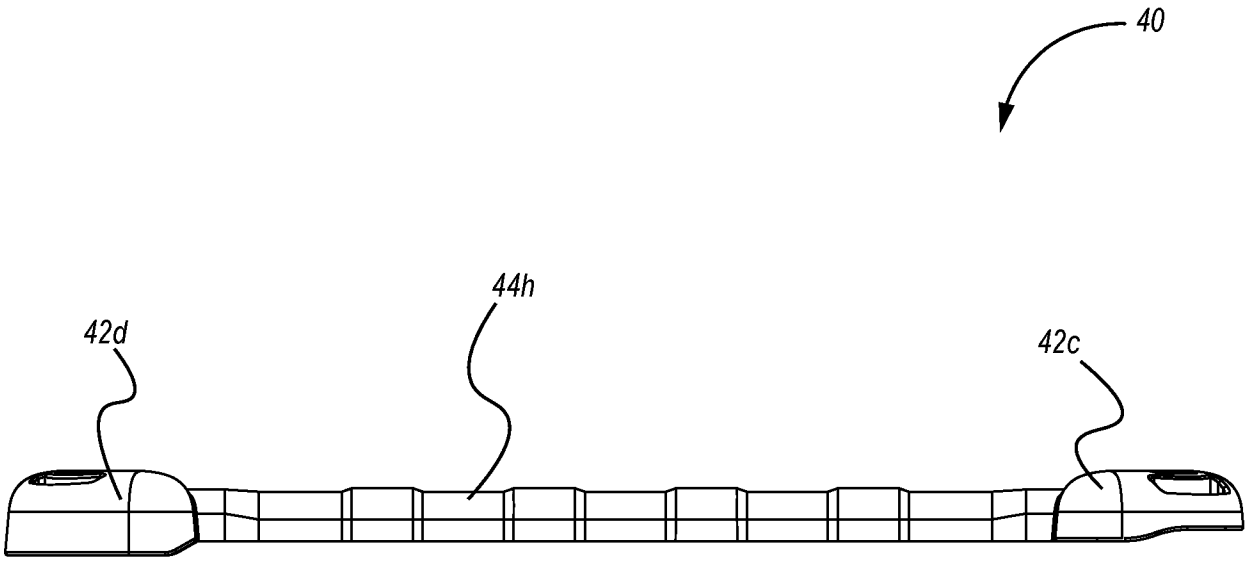
FIG. 10 is a side-elevational view of the second material component of FIG. 6.

Turning to FIG. 10, depicted therein is a side-elevational view of second material component 40.

Figure 11:
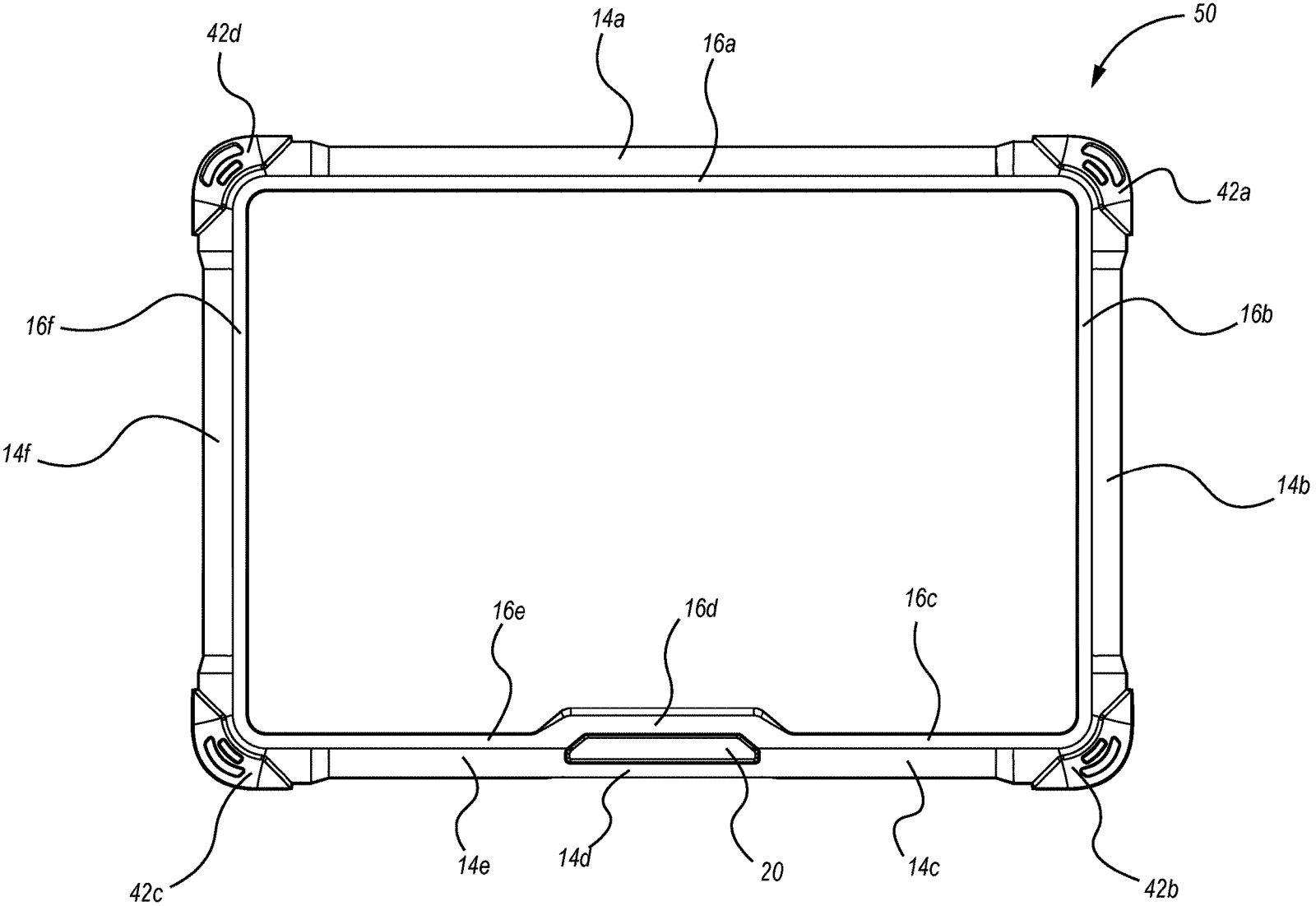
FIG. 11 is a top plan view of a two-component subassembly.

Turning to FIG. 11, depicted therein is a top plan view of two-component sub-assembly 50.

As described above, in implementations, first material component 10 can be selected from such materials as ABS—acrylonitrile butadiene styrene, PC—polycarbonate, PMMA—polymethy methacrylate, PP—polypropylene, PET—polyethylene terephthalate, etc. In contrast, as described above, in implementations, second material component 40 can be selected from materials such as TPE—thermoplastic elastomer, TPU—thermoplastic polyurethane, which are less dense than those materials for first material component 10. Thus, second material component 40 generally feels softer to the touch than first material component 10.

Furthermore, since more conventional forms of TPE and TPU used by implementations of second material component 40 implementations do not readily bond with materials being used by implementations of first material component 10, bondable forms TPE and TPU can be used for implementations of second material component 40 to be co-molded with materials being used by implementations of first material component 10. As noted above, materials being used by implementations of first material component 10 are molded beforehand so that first material component 10 is already a solid before it is co-molded with materials being used by implementations of second material component 40.

Such co-molding at relatively lower temperature (such as a temperature range between 300 degrees Fahrenheit and 400 degrees Fahrenheit, etc.) than what is used for conventional molding of TPE or TPU, yields a sufficiently delicate bond to enhance ease of disassembly at lifecycle end yet still allows for a reasonable amount of tamper resistance during lifecycle duration.

Although this characteristically delicate bond between second material component 40 and first material component 10 deviates from general use of materials (such as TPE, TPU, etc.) for implementations of second material component 40 since these materials are typically molded at higher temperatures for non-separable bond, utilizing these materials in this unintended manner results in a semi-permanent bond. Such semi-permanent bond is ideal for disassembly in challenging environments, such as situations where kids may otherwise effortlessly dismantle a bond of lesser strength than this semi-permanent bond being presently discussed.

Based on this predetermined type of co-molding of moldable TPE, TPU, etc. for implementations of second material component 40 with the pre-molded harder materials for implementations of first material component 10 and a predetermined overlap (such as measured as one or more overlap widths or one or more overlap areas) between first material component 10 and second material component 40 adjacent to a release mechanism to receive an applied force such as upon aperture plug 44*f* allows for a predetermined bond strength of release that can be tailored to the application at hand such as having a bond strength of release of 15 to 20 pounds force, which can be sufficiently great to resist inadvertent disassembly of 10 from 40 but not require an inconvenient amount of force when disassembly of 10 from 40 is desired.

Figure 12:
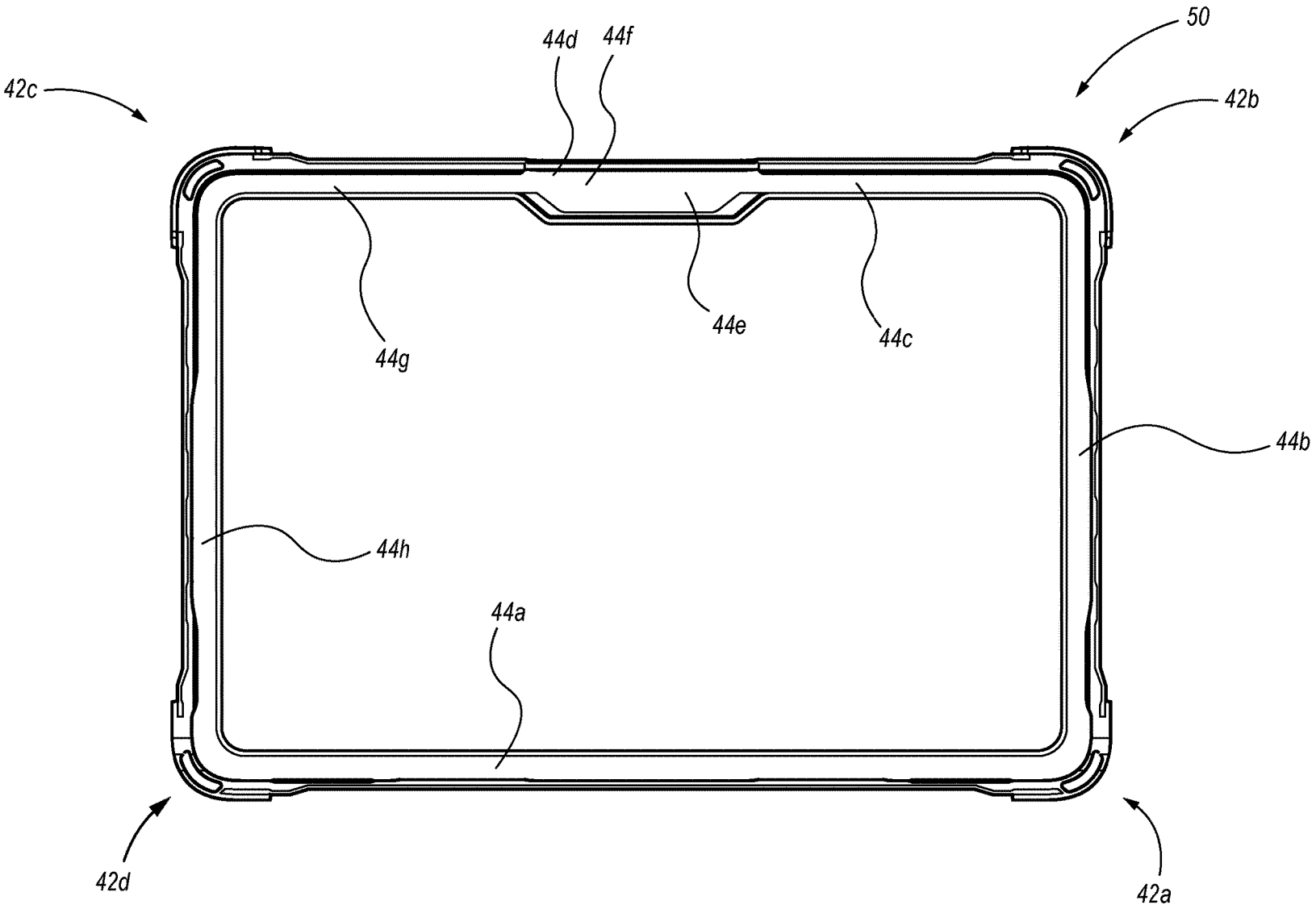
FIG. 12 is a bottom plan view of the two-component subassembly of FIG. 11.

Turning to FIG. 12, depicted therein is a bottom plan view of two-component sub-assembly 50.

Figure 13:
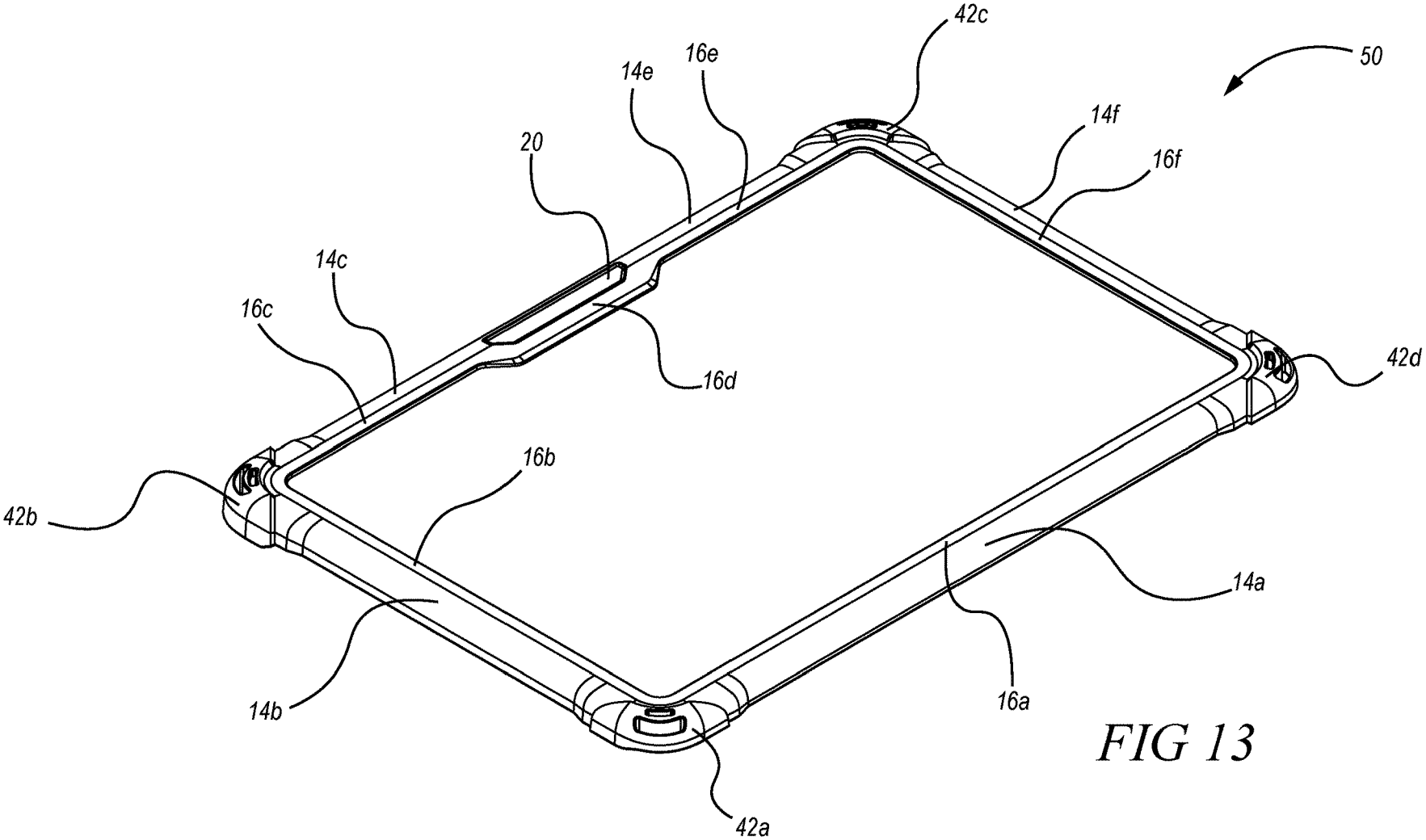
FIG. 13 is a top perspective view of the two-component subassembly of FIG. 11.

Turning to FIG. 13, depicted therein is a top perspective view of two-component sub-assembly 50.

Figure 14:
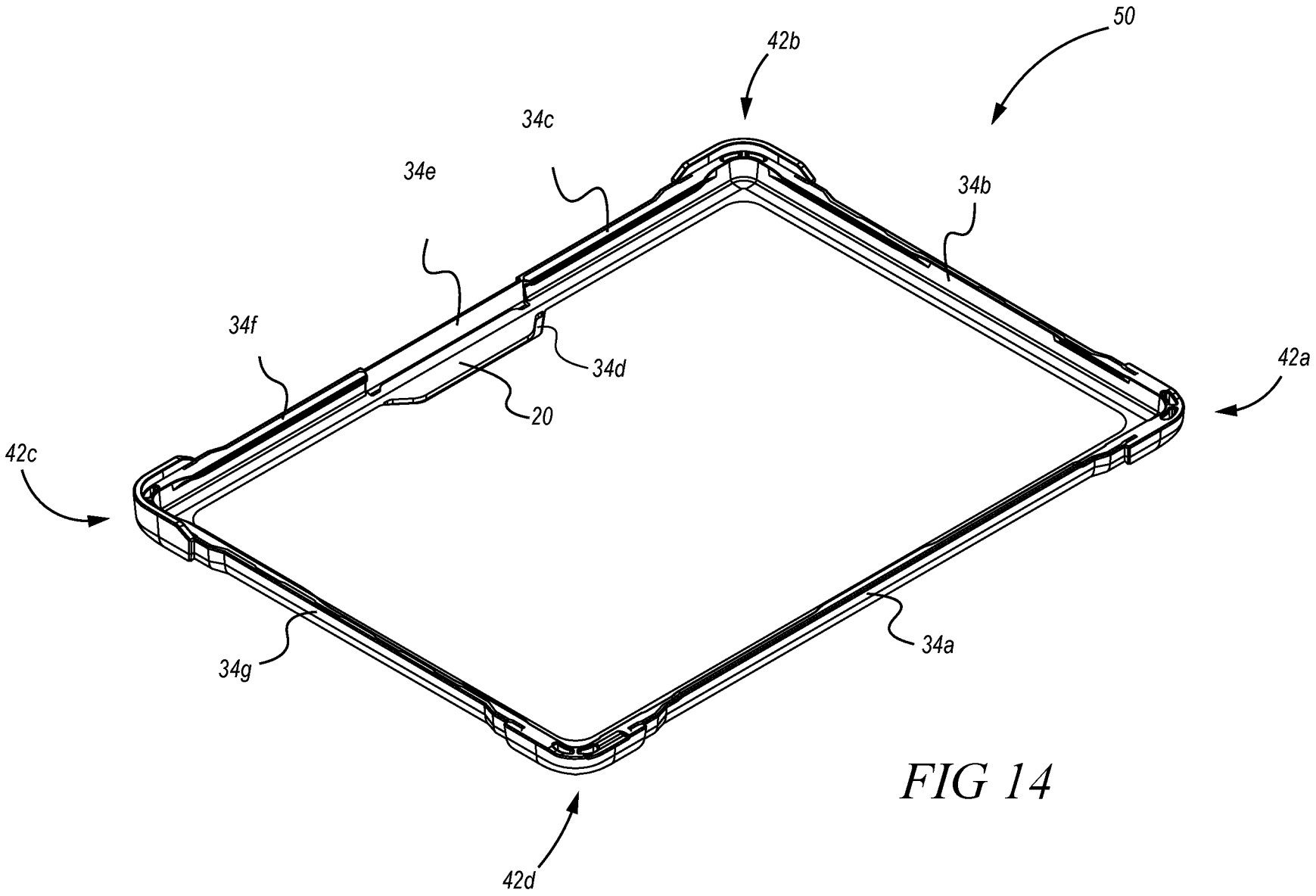
FIG. 14 is a bottom perspective view of the two-component subassembly of FIG. 11.

Turning to FIG. 14, depicted therein is a bottom perspective view of two-component sub-assembly 50.

Figure 15:
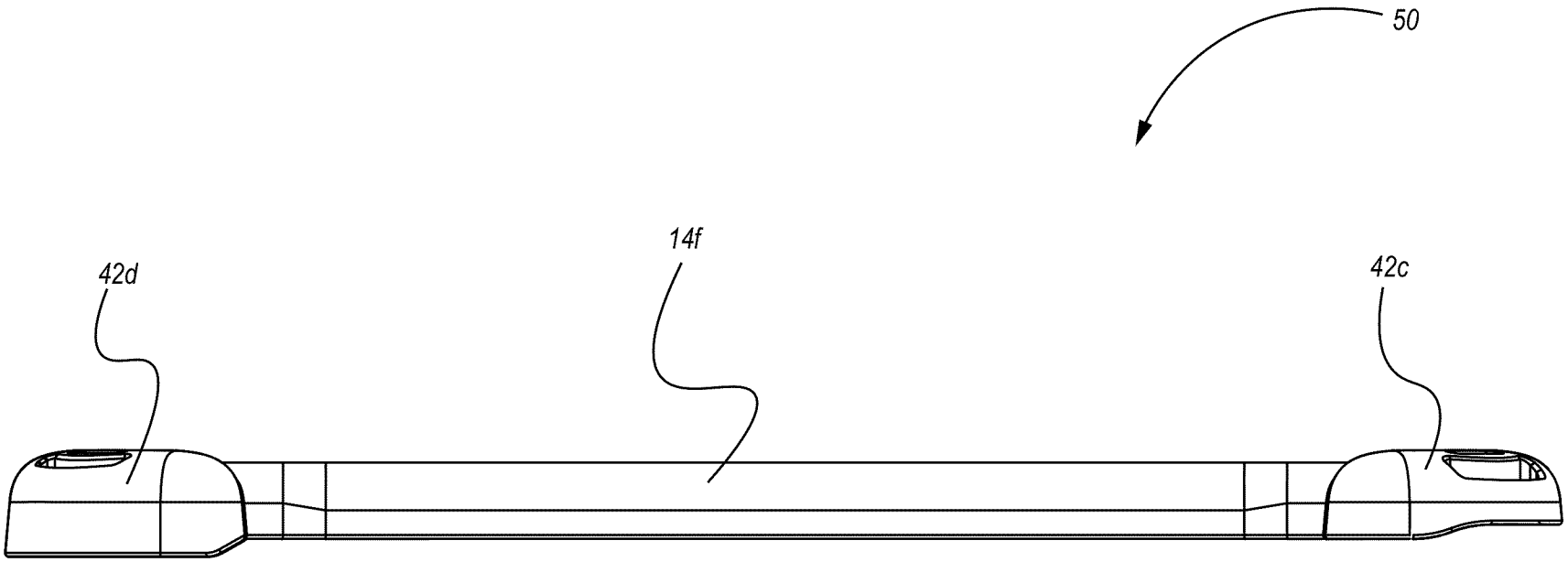
FIG. 15 is a side-elevational view of the two-component subassembly of FIG. 11.

Turning to FIG. 15, depicted therein is a side-elevational view of two-component sub-assembly 50.

Figure 16:
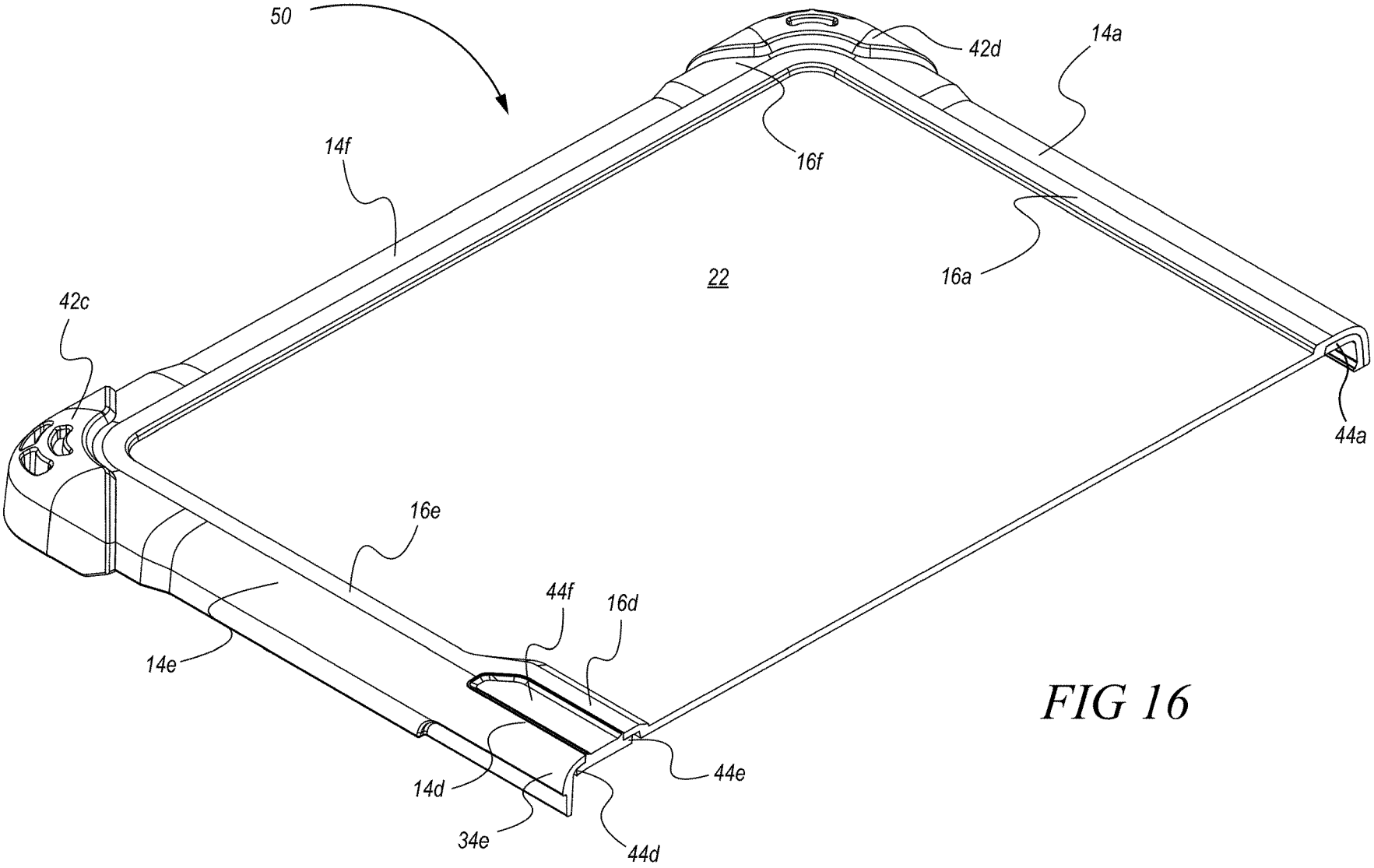
FIG. 16 is an cross-sectional top perspective view of a portion of the two-component subassembly of FIG. 11.

Turning to FIG. 16, depicted therein is a cross-sectional top perspective view of a portion of two-component sub-assembly 50.

Figure 17:
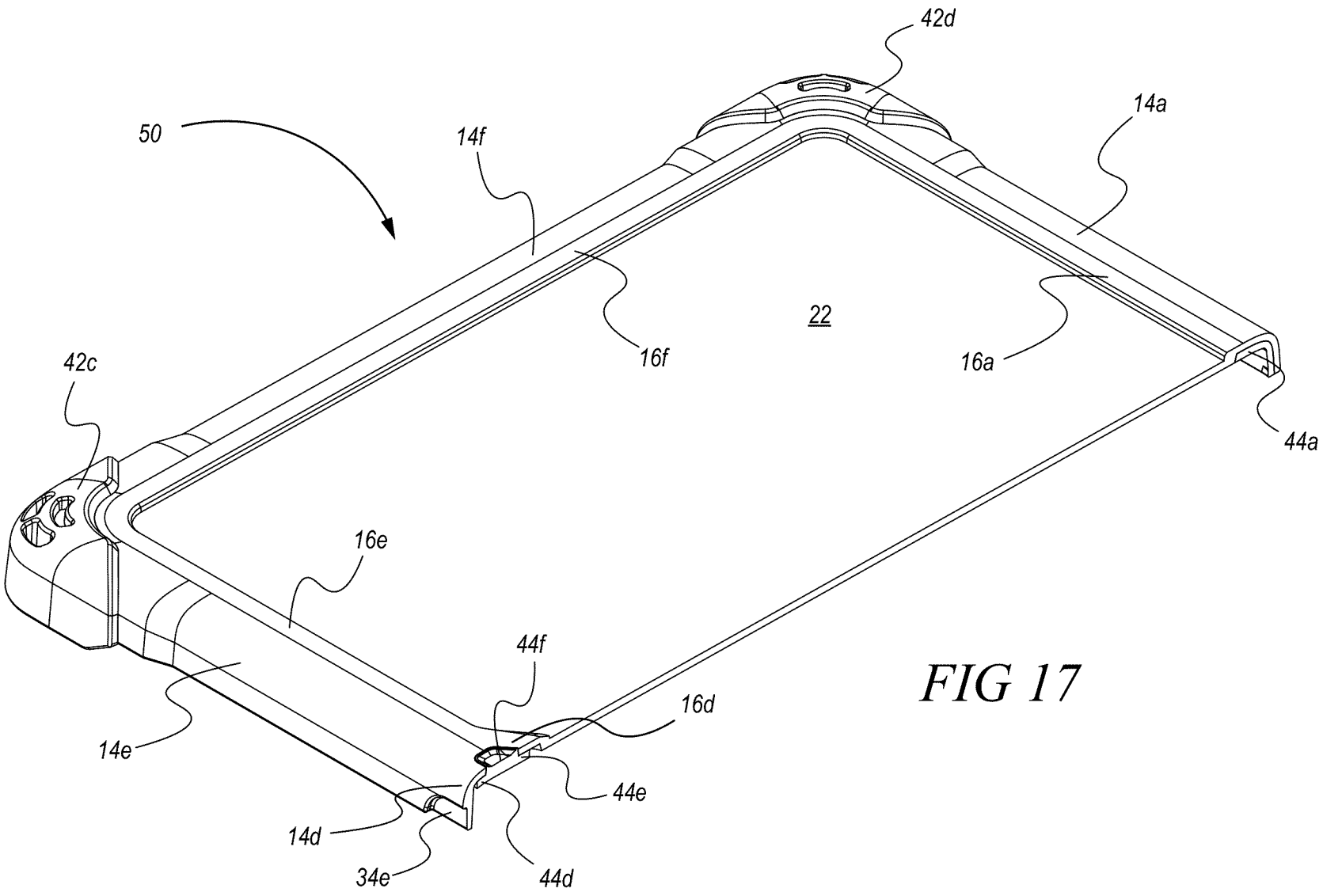
FIG. 17 is an cross-sectional top perspective view of a portion of the two-component subassembly of FIG. 11.

Turning to FIG. 17, depicted therein is a cross-sectional top perspective view of a portion of two-component sub-assembly 50.

Figure 18:
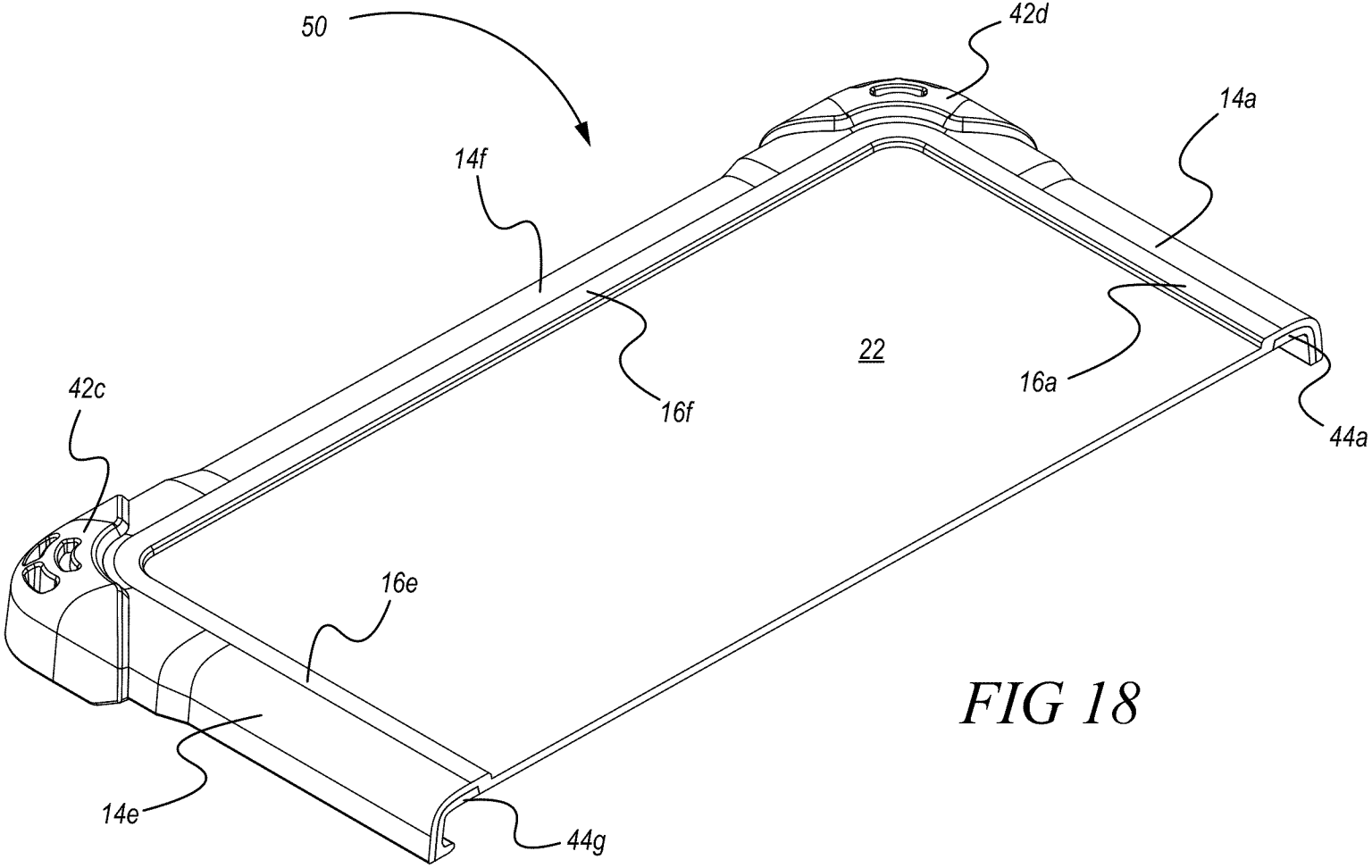
FIG. 18 is an cross-sectional top perspective view of a portion of the two-component subassembly of FIG. 11.

Turning to FIG. 18, depicted therein is a cross-sectional top perspective view of a portion of two-component sub-assembly 50.

Figure 19:
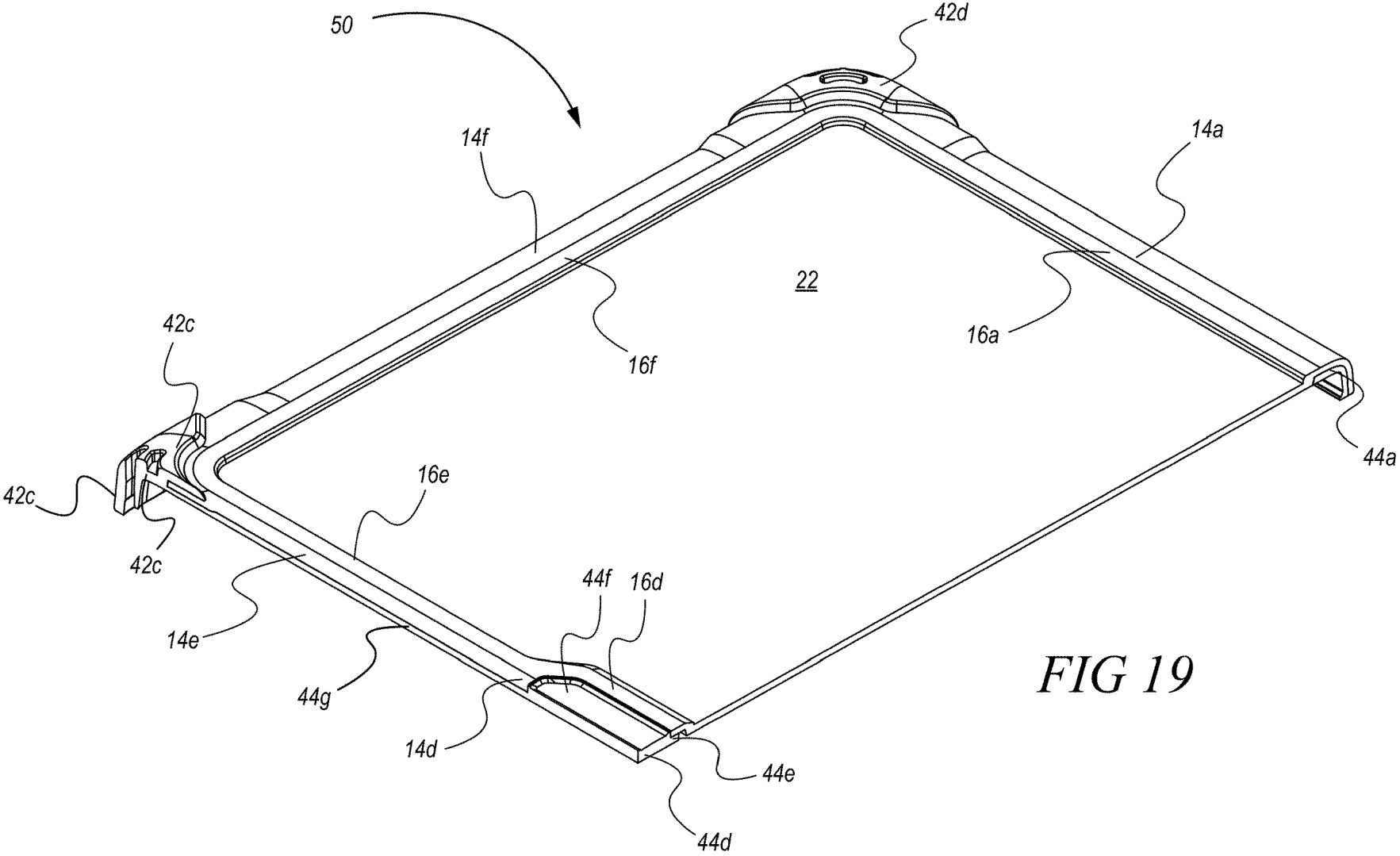
FIG. 19 is an cross-sectional top perspective view of a portion of the two-component subassembly of FIG. 11.

Turning to FIG. 19, depicted therein is a cross-sectional top perspective view of a portion of two-component sub-assembly 50.

Figure 20:
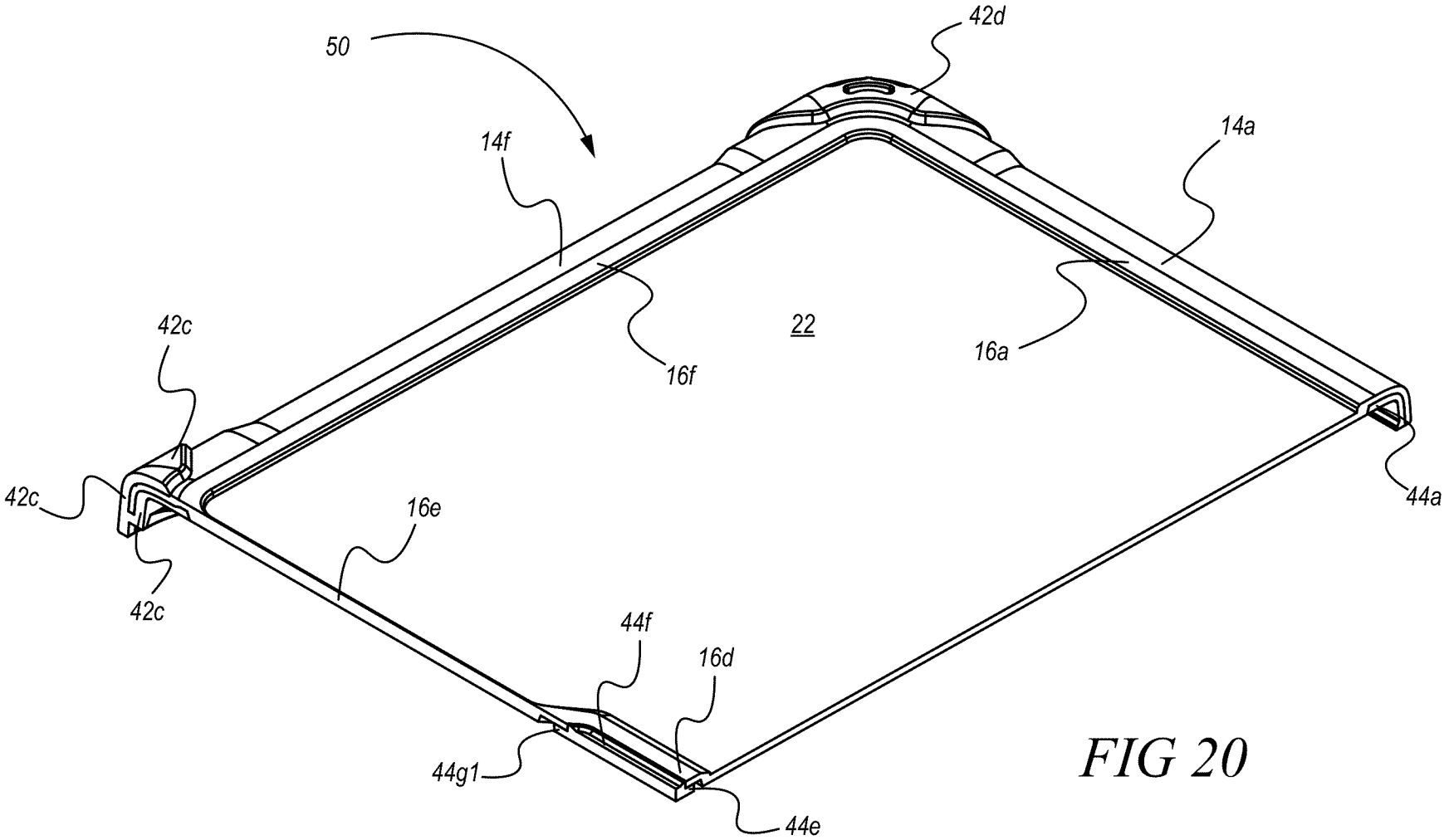
FIG. 20 is an cross-sectional top perspective view of a portion of the two-component subassembly of FIG. 11.

Turning to FIG. 20, depicted therein is a cross-sectional top perspective view of a portion of two-component sub-assembly 50.

Figure 21:
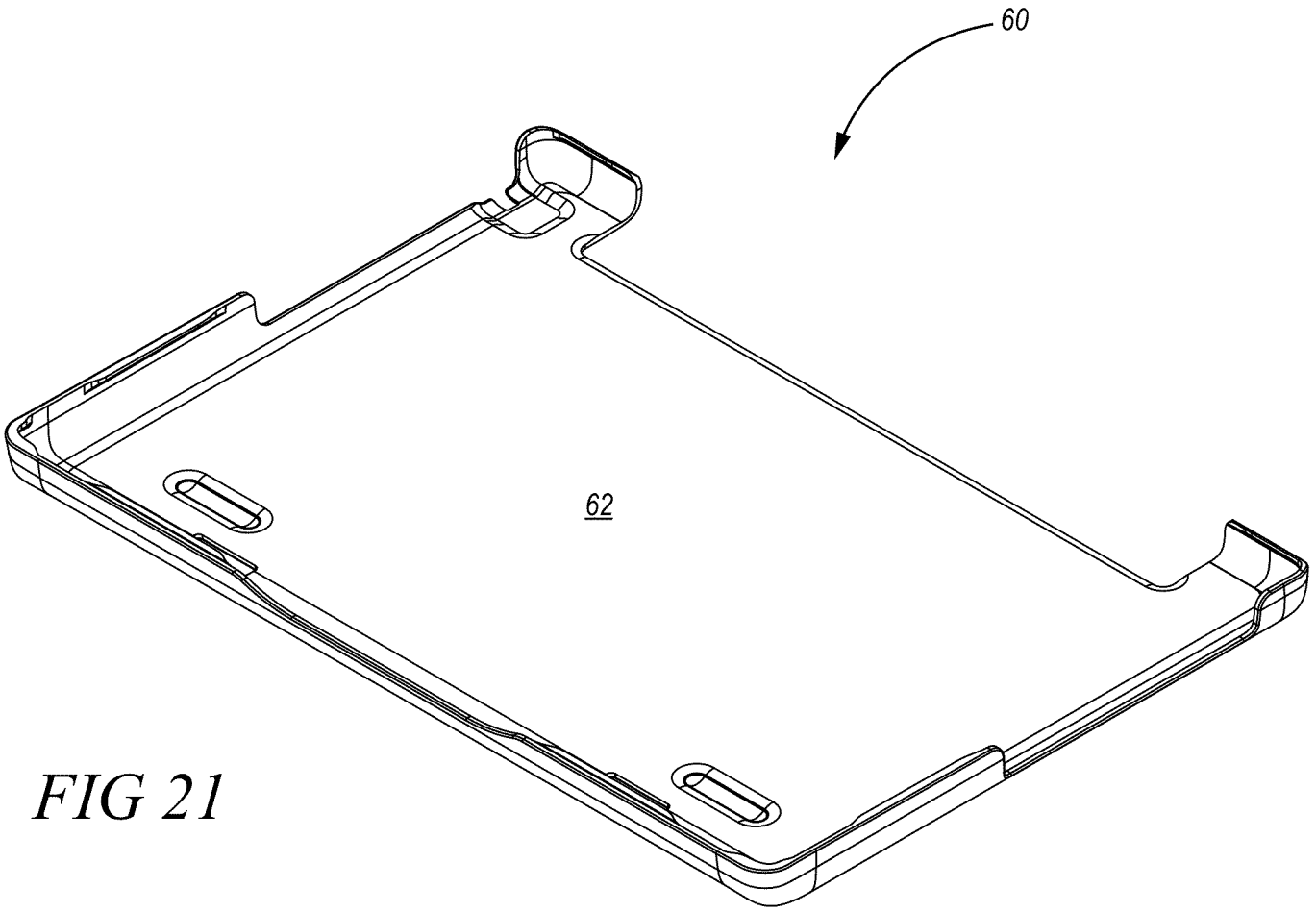
FIG. 21 is a top perspective view of a one-component subassembly.

Turning to FIG. 21, depicted therein is a top perspective view of single component sub-assembly 60. Depicted implementation of single component sub-assembly 60 is shown to include front 62.

Figure 22:
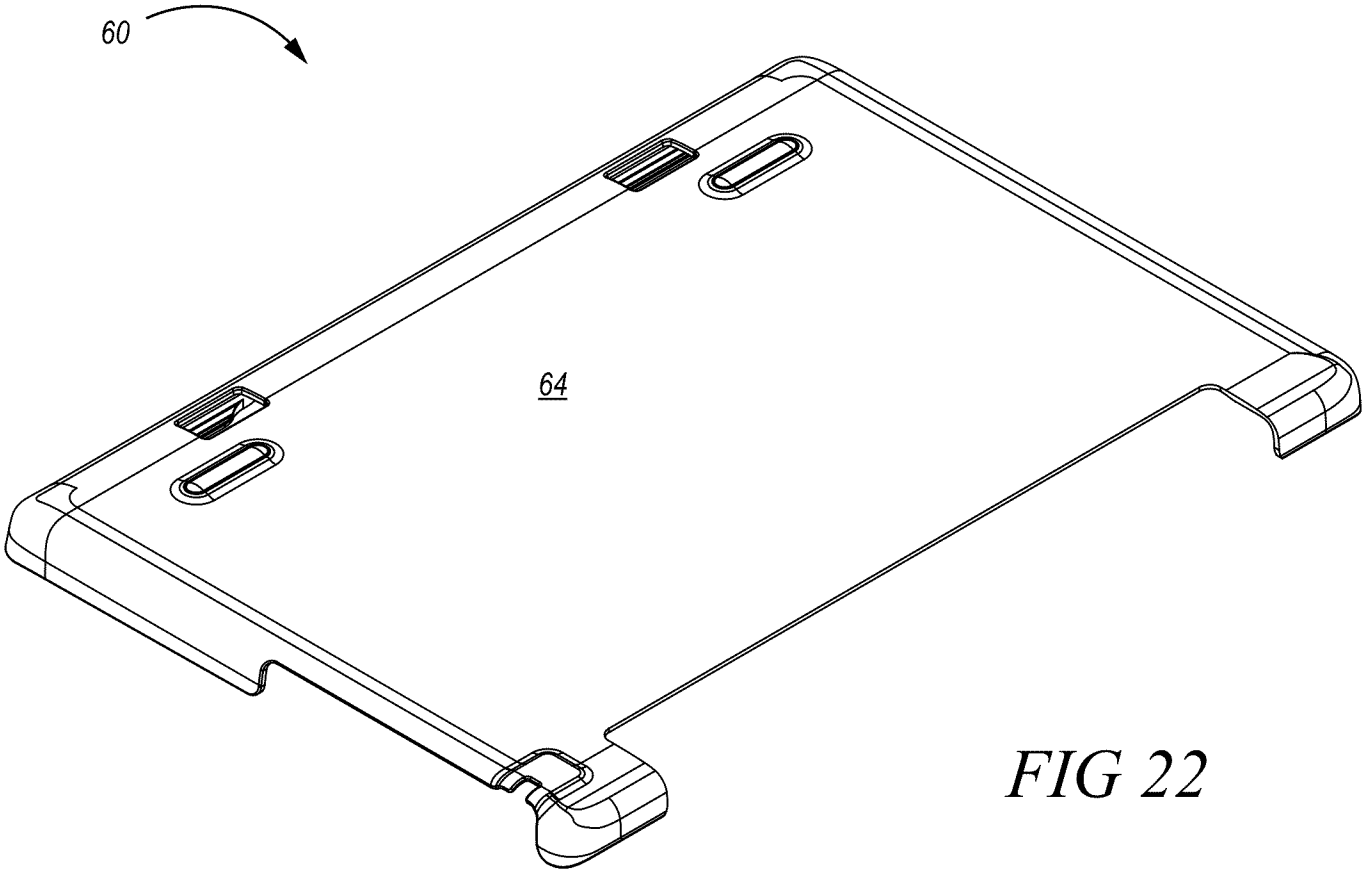
FIG. 22 is a bottom perspective view of the one-component subassembly of FIG. 21.

Turning to FIG. 22, depicted therein is a bottom perspective view of single component sub-assembly 60. Depicted implementation of single component sub-assembly 60 is shown to include rear 64.

Figure 23:
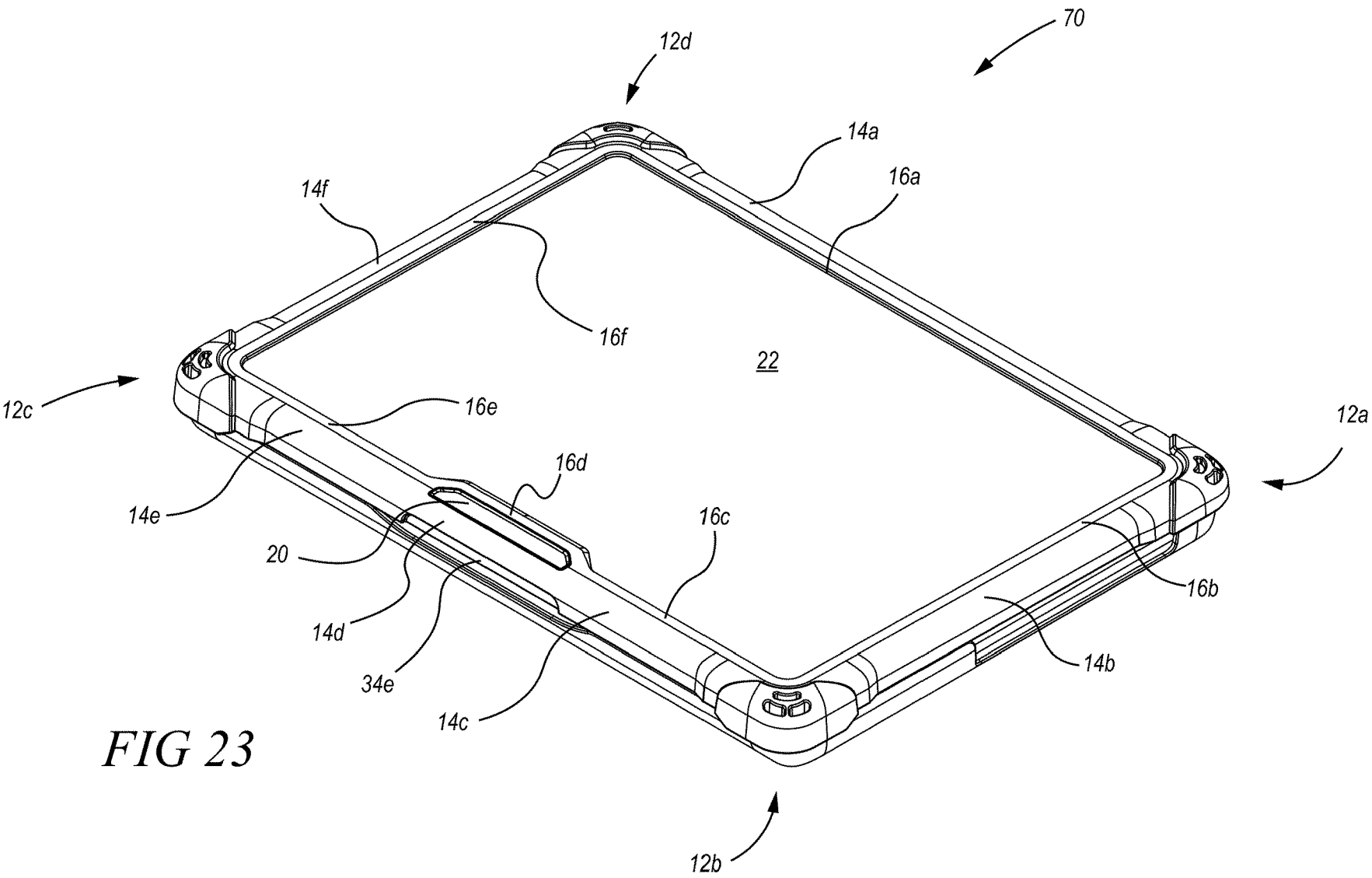
FIG. 23 is a top perspective view of a case assembly.

Turning to FIG. 23, depicted therein is a top perspective view of case assembly 70, which can be used to contain a portable electronic device (not shown). In other implementations of two-component assemblies using the materials and co-molding techniques of this present application can include cases such as gun cases, insulated coolers, liquid containers, helmets, food storage containers, global positioning system devices, protective gear (such as for motorcyclists or sports enthusiasts), laptops, phones, toolboxes, luggage, etc.

Figure 24:
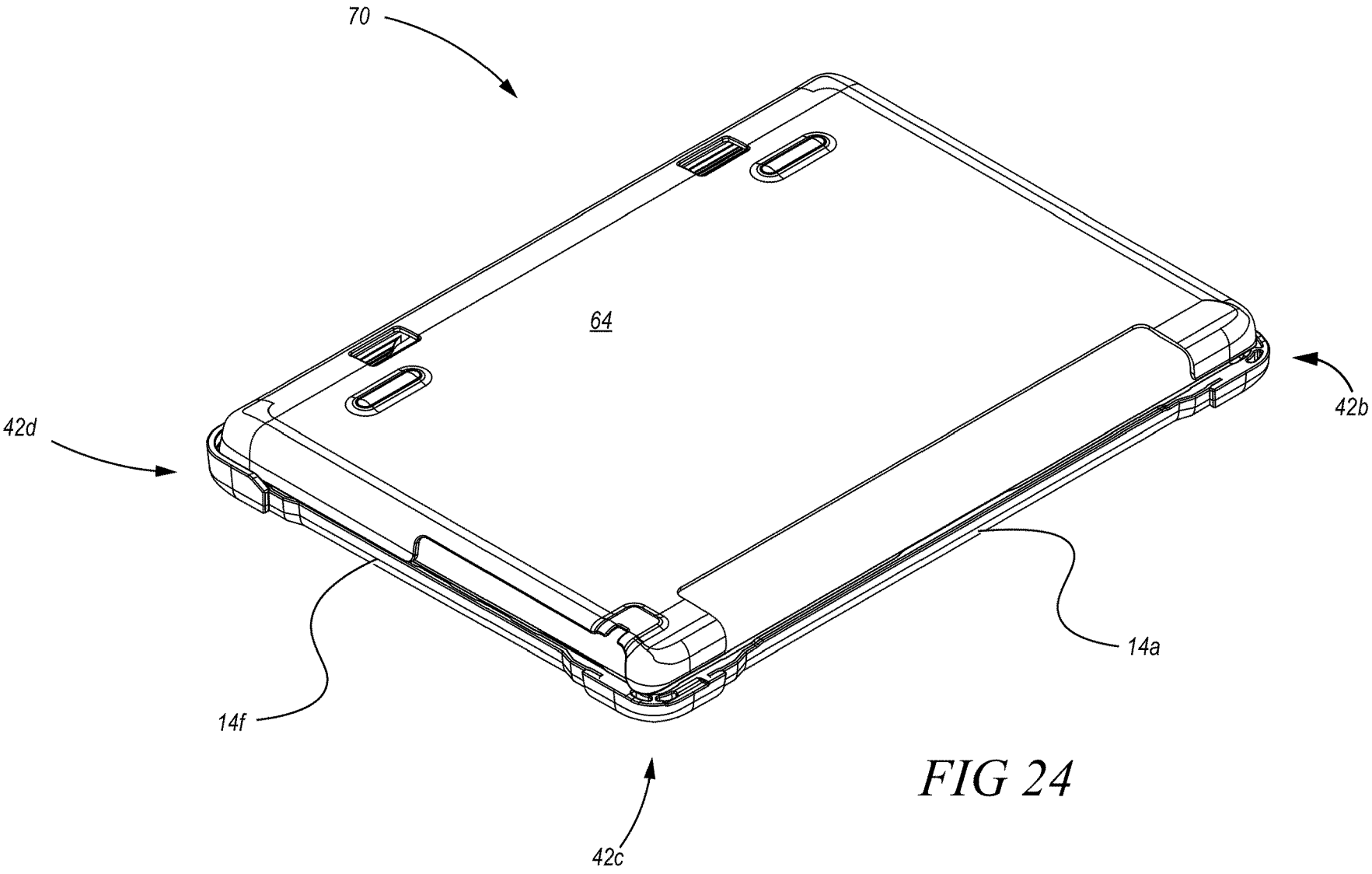
FIG. 24 is a bottom perspective view of the case assembly of FIG. 23.

Turning to FIG. 24, depicted therein is a bottom perspective view of case assembly 70.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A case system comprising:

(I) a first material component including (A) at least one aperture including at least one edge, (B at least one border portion extending from the at least one edge of the aperture, and (C) at least one elongated portion; and (II) a second material component including (A) at least one aperture plug portion extending through the at least one aperture of the first material component, and (B) at least one edge portion extending from the plug portion, wherein the at least one border portion of the first material and the at least one edge portion of the second material are coupled via co-molding, and wherein the first material component is molded before being co-molded with the second material component.

2. The case system of claim 1 wherein the first material component has a first density, wherein the second material component has a second density, and wherein the first density is greater than the second density.

3. The case system of claim 1 wherein the second material component includes at least one thermoplastic elastomer.

4. The case system of claim 1 wherein the second material component includes at least one thermoplastic polyurethane.

5. The case system of claim 1 wherein the first material component includes at least one polycarbonate.

6. The case system of claim 1 wherein the first material component includes at least one acrylonitrile butadiene styrene.

7. The case system of claim 1 wherein when a force applied to the at least one plug portion greater than a predetermined force, the at least one border portion of the first material component and the at least one edge portion of the second material component separate from one another.

8. The case system of claim 7 wherein the predetermined force is greater than 15 pounds.

9. The case system of claim 7 wherein the predetermined force is dependent upon at least one dimension of the at least one border portion of the first material component.

10. The case system of claim 9 wherein the at least one dimension is at least one width of the at least one border portion of the first material component.

11. The case system of claim 7 wherein the predetermined force is dependent upon a dimension of the at least one edge portion of the second material component.

12. The case system of claim 11 wherein the at least one dimension is at least one area of the at least one edge portion of the second material component.

13. The case system of claim 1 wherein the first material component and the second material component are co-molded in a predetermined temperature range.

14. The case system of claim 13 wherein the predetermined temperature range includes a temperature range between 300 degrees Fahrenheit and 400 degrees Fahrenheit.

15. The case system of claim 1 wherein the aperture is noncircular.

16. The case system of claim 1 wherein the first material component further includes at least one elongated portion extending from the at least one aperture, wherein the second material component further includes at least one elongated portion extending from the at least one aperture plug portion, wherein the at least one elongated portion of the first material component and the at least one elongated portion of the second material component are coupled via co-molding, wherein the first material component further includes at least one corner portion spaced from the at least one aperture, wherein the second material component further includes at least one corner portion spaced from the at least one aperture plug portion, and wherein the at least one corner portion of the first material component and the at least one corner portion of the second material component are coupled via co-molding.

17. The case system of claim 16 wherein the at least one elongated portion of the first material component is separable from the at least one elongated portion of the second material component via at least one pulling force subsequent to separation of the at least one border portion of the first material from the at least one edge portion of the second material, and wherein the at least one corner portion of the first material component is separable from the at least one corner portion of the second material component via at least one pulling force subsequent to separation of the at least one border portion of the first material from the at least one edge portion of the second material.

18. The case system of claim 1 wherein the first material component and the second material component form at least a sub-assembly portion of a case for a portable electronic device.

19. A case system comprising:

(I) a first material component including (A) at least one aperture including at least one edge, (B at least one border portion extending from the at least one edge of the aperture, and (C) at least one elongated portion; and (II) a second material component including (A) at least one aperture plug portion extending through the at least one aperture of the first material component, (B) at least one edge portion extending from the plug portion, wherein the at least one border portion of the first material and the at least one edge portion of the second material are coupled via co-molding at a temperature in a temperature range between 300 degrees Fahrenheit and 400 degrees Fahrenheit, and wherein the first material component is molded before the co-molding with the second material component.

20. A case system comprising:

(I) a first material component including (A) at least one aperture including at least one edge, (B at least one border portion extending a width dimension from the at least one edge of the aperture, and (C) at least one elongated portion; and (II) a second material component including (A) at least one aperture plug portion extending through the at least one aperture of the first material component, and (B) at least one edge portion extending the width dimension from the plug portion, wherein the at least one border portion of the first material and the at least one edge portion of the second material are coupled via co-molding, and wherein the first material component has a first density and the second material component has a second density smaller than the first density of the first material component.

* * * * *